US009970627B2

(12) United States Patent
Lee et al.

(10) Patent No.: US 9,970,627 B2
(45) Date of Patent: May 15, 2018

(54) LAMP UNIT AND VEHICLE LAMP APPARATUS INCLUDING THE SAME

(71) Applicant: LG INNOTEK CO., LTD., Seoul (KR)

(72) Inventors: Jung Ho Lee, Seoul (KR); Jun Suk Yang, Seoul (KR); Jae Myeong Noh, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days. days.

(21) Appl. No.: 14/457,988

(22) Filed: Aug. 12, 2014

(65) Prior Publication Data

US 2014/0347854 A1 Nov. 27, 2014

Related U.S. Application Data

(63) Continuation of application No. 14/108,878, filed on Dec. 17, 2013.

(30) Foreign Application Priority Data

Dec. 18, 2012 (KR) ..... 10-2012-0148014

(51) Int. Cl.
*F21V 5/00* (2015.01)
*F21S 8/10* (2006.01)
(Continued)

(52) U.S. Cl.
CPC ..... *F21V 5/007* (2013.01); *F21K 9/27* (2016.08); *F21S 48/211* (2013.01);
(Continued)

(58) Field of Classification Search
CPC ..... F21S 48/1122; F21V 17/16; F21V 17/164
(Continued)

(56) References Cited

U.S. PATENT DOCUMENTS 5,490,049 A * 2/1996 Montalan et al. ..... 362/240
7,445,359 B2 11/2008 Chang ..... 362/331
(Continued)

FOREIGN PATENT DOCUMENTS

CN 101939588 1/2011
CN 102282416 12/2011
(Continued)

OTHER PUBLICATIONS

Machine translation of "Foerstner et al.", DE 102008055936 A1, published May 6, 2010.*
(Continued)

*Primary Examiner* — William N Harris
(74) *Attorney, Agent, or Firm* — Ked & Associates LLP

(57) ABSTRACT

A lamp unit which implements a source light source with a small number of light sources using a lens and a vehicle lamp apparatus including the same. The lamp unit includes an optical member, a base plate spaced from the optical member by a predetermined distance, and a spacer between the base plate and the optical member. The spacer supports an edge of the optical member, and a light source is disposed on the base plate. A lens is coupled to the base plate, and the lens covers the light source. The lens includes a connection portion contacting the base plate, and a reinforcement part contacting the spacer.

16 Claims, 19 Drawing Sheets

(51) Int. Cl.

| | |
|---|---|
| ***F21V 5/04*** | (2006.01) |
| ***F21V 17/16*** | (2006.01) |
| ***F21Y 115/10*** | (2016.01) |
| ***F21K 9/27*** | (2016.01) |

(52) U.S. Cl.
CPC ..... *F21S 48/215* (2013.01); *F21S 48/2206* (2013.01); *F21S 48/2212* (2013.01); *F21V 5/04* (2013.01); *F21V 5/046* (2013.01); *F21V 5/048* (2013.01); *F21V 17/164* (2013.01); *F21Y 2115/10* (2016.08)

(58) Field of Classification Search
USPC ..... 362/311.06, 311.01, 240, 543, 544, 545, 362/343, 353, 455, 433, 223, 219, 225, 362/268
See application file for complete search history.

(56) References Cited

U.S. PATENT DOCUMENTS

| | | | | |
|---|---|---|---|---|
| 8,366,297 | B2 * | 2/2013 | Kretschmann et al. | 362/249.04 |
| 8,408,753 | B2 | 4/2013 | Chen | 362/311.1 |
| 2006/0193137 | A1 | 8/2006 | Chinniah et al. | |
| 2007/0230182 | A1 * | 10/2007 | Tai | F21V 17/06 362/294 |
| 2007/0268703 | A1 | 11/2007 | Gasquet et al. | |
| 2008/0100773 | A1 * | 5/2008 | Hwang et al. | 349/62 |
| 2008/0165541 | A1 * | 7/2008 | Chou | F21V 5/04 362/311.06 |
| 2009/0310356 | A1 | 12/2009 | Laporte | 362/239 |
| 2010/0052546 | A1 * | 3/2010 | Williams et al. | 315/152 |
| 2010/0265721 | A1 | 10/2010 | Zhou | |
| 2011/0007493 | A1 | 1/2011 | Ishio et al. | |
| 2011/0121341 | A1 * | 5/2011 | Lee | H01L 33/58 257/98 |
| 2011/0194279 | A1 | 8/2011 | Kuo | |
| 2012/0043560 | A1 | 2/2012 | Wu et al. | |
| 2012/0106191 | A1 | 5/2012 | Duong et al. | 362/555 |
| 2012/0113651 | A1 | 5/2012 | Kuo | 362/311.01 |
| 2012/0182731 | A1 | 7/2012 | Kretschmann et al. | |
| 2015/0338056 | A1 * | 11/2015 | Pelka | F21V 5/04 362/311.01 |
| 2016/0003420 | A1 * | 1/2016 | Lee | H01L 33/58 362/311.01 |
| 2016/0003421 | A1 * | 1/2016 | Lee | H01L 33/58 362/311.01 |

FOREIGN PATENT DOCUMENTS

| | | | |
|---|---|---|---|
| CN | 102588833 | | 7/2012 |
| DE | 10 2005 020 908 | | 8/2006 |
| DE | 10-2008-031256 | | 1/2010 |
| DE | 10 2008 055 936 | | 5/2010 |
| EP | 0 585 186 | | 3/1994 |
| EP | 1 860 707 | | 11/2007 |
| EP | 2 306 069 | A1 | 4/2011 |
| EP | 2 309 296 | A1 | 4/2011 |
| EP | 2 378 338 | A1 | 10/2011 |
| EP | 2 439 442 | | 4/2012 |
| FR | 2 867 257 | | 9/2005 |
| JP | 2004-362840 | | 12/2004 |
| JP | 2009-152142 | | 7/2009 |
| JP | 2009-230984 | | 10/2009 |
| JP | 2010-027252 | | 2/2010 |
| JP | 2011-198473 | | 10/2011 |
| JP | 2012-028161 | | 2/2012 |
| JP | 2013-242499 | | 12/2013 |
| KR | 10-1054157 | | 8/2011 |
| KR | 10-1133184 | | 4/2012 |
| WO | WO 2009/077578 | | 6/2009 |
| WO | WO 2009/089973 | | 7/2009 |
| WO | WO 2009/089973 | A1 | 7/2009 |
| WO | WO 2010/052135 | | 5/2010 |
| WO | WO 2012/096203 | | 7/2012 |

OTHER PUBLICATIONS

European Search Report dated Sep. 15, 2014, issued in Application No. 13198049.2.
Office Action dated Nov. 4, 2014, issued in U.S. Appl. No. 14/108,878.
U.S. Office Action issued in co-pending U.S. Appl. No. 14/108,878 dated Jul. 31, 2015.
European Search Report dated Oct. 19, 2015.
U.S. Office Action issued in U.S. Appl. No. 14/108,878 dated Nov. 19, 2015.
European Office Action issued in Application No. 13 198 049.2 dated Aug. 11, 2015.
European Exannination Report dated Apr. 15, 2016.
European Examination Report dated Jul. 21, 2016.
U.S. Office Action dated Oct. 25, 2016 issued in U.S. Appl. No. 14/108,878.
U.S. Office Action issued in U.S. Appl. No. 14/108,878 dated Jun. 2, 2016.
Chinese Office Action dated Feb. 27, 2017 issued in Application No. 201310700864.X.
European Search Report dated Mar. 9, 2017 issued in Application No. 15172020.8.
Chinese Office Action dated Sep. 13, 2017. (English Translation).
Japanese Office Action dated Oct. 17, 2017.

* cited by examiner

LAMP UNIT AND VEHICLE LAMP APPARATUS INCLUDING THE SAME

CROSS REFERENCE TO RELATED APPLICATION

This application is a Continuation application of prior co-pending U.S. patent application Ser. No. 14/108,878, filed Dec. 17, 2013, which claims priority under 35 U.S.C. § 119 to Korean Patent Application No. 10-2012-0148014, filed in Korea on Dec. 18, 2012, which are hereby incorporated in its entirety by reference as if fully set forth herein.

BACKGROUND

1. Field

Embodiments relate to a lamp unit including a surface light source and a vehicle lamp apparatus using the same.

2. Background

In general, a lamp is a device which supplies or controls light for a certain purpose.

An incandescent lamp, a fluorescent lamp, a neon lamp or the like may be used as a lamp light source and a light emitting diode (LED) is recently used.

An LED is a device which converts an electrical signal into infrared or visible light using characteristics of compound semiconductors and causes almost no environmental pollution because it does not use a harmful substance such as mercury as compared to fluorescent lamps.

In addition, LEDs have longer lifespan than incandescent lamps, fluorescent lamps and neon lamps. In addition, LEDs have advantages of low power consumption, and superior visibility and less glare due to high color temperature, as compared to incandescent lamps, fluorescent lamps and neon lamps.

FIG. 1 is a view illustrating a general lamp unit.

As shown in FIG. 1, the lamp unit includes a light source module 1 and a reflector 2 to determine an orientation angle of light emitted from the light source module 1.

The light source module 1 may include at least one LED light source 1*a* provided on a printed circuit board (PCB) 1*b*.

In addition, the reflector 2 collects light emitted from the LED light source 1*a* and guides the light to emit through an opening at a predetermined orientation angle, and has a reflection surface on an inside surface thereof.

As described above, the lamp unit is a lamp which obtains light collected from a plurality of LED light sources 1*a*. The lamp using LEDs may be used for backlights, display devices, lightings, vehicle pilot lamps, headlamps and the like according to application thereof.

In particular, it is considerably important for vehicle drivers to dearly distinguish luminous state of lamp units because the lamp units used for vehicles are closely related to safe driving of vehicles.

Accordingly, it may be necessary that lamp units used for vehicles secure light dose suitable for safe driving as well as appearance aesthetics of vehicles.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
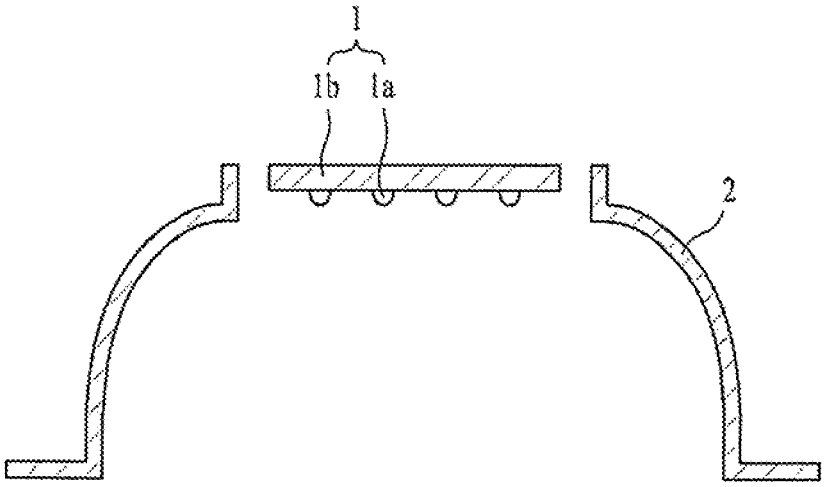
Fig. 1 RELATED ART
FIG. 1 is a view illustrating a general lamp unit.

Hereinafter, embodiments will be described with reference to the annexed drawings.

It will be understood that when an element is referred to as being "on" or "under" another element, it can be directly on/under the element, and one or more intervening elements may also be present. When an element is referred to as being "on" or "under", "under the element" as well as "on the element" may be included based on the element.

In the drawings, the thickness or size of each layer is exaggerated, omitted, or schematically illustrated for convenience of description and clarity. In addition, the size or area of each constituent element does not entirely reflect the actual size thereof.

Figure 2:
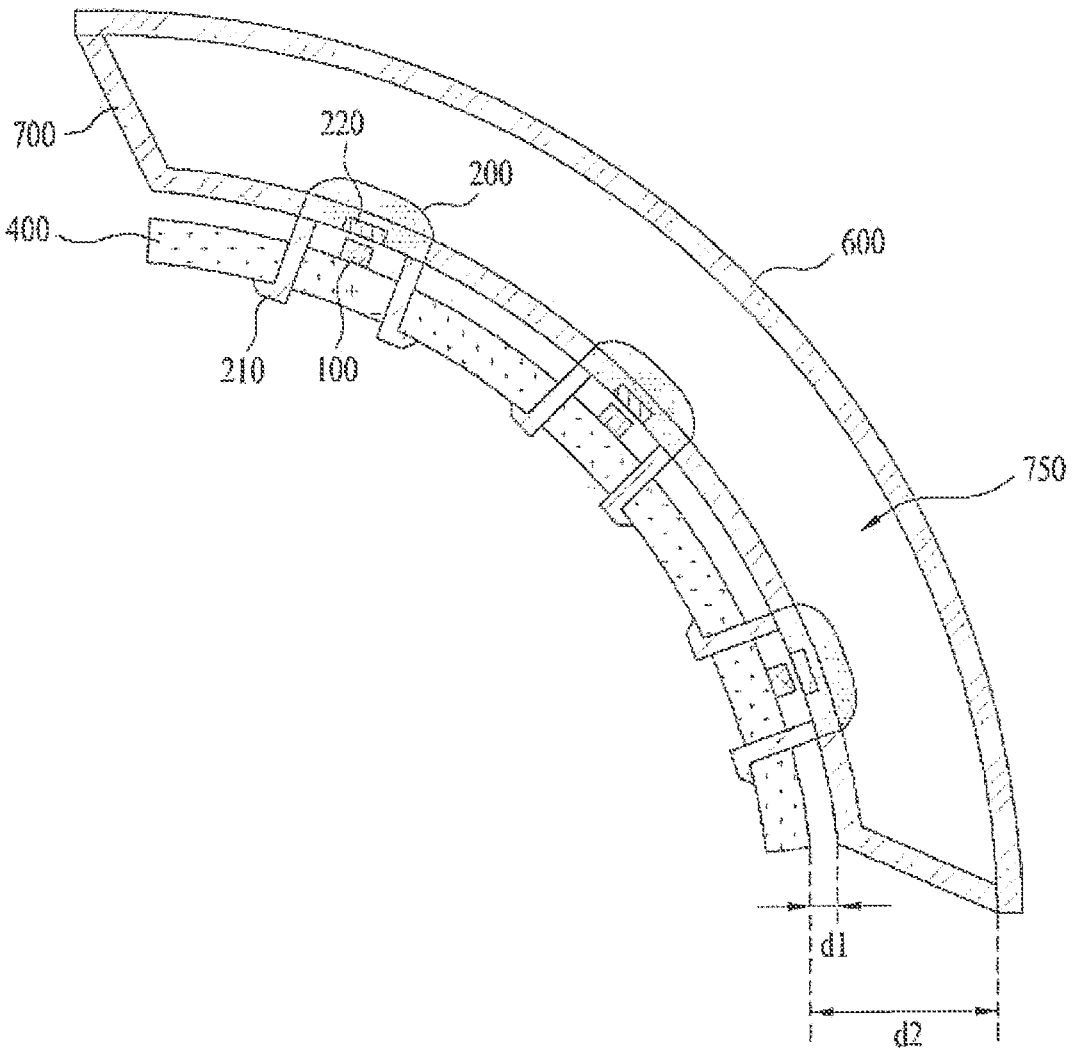
FIG. 2 is a sectional view illustrating a lamp unit according to an embodiment.

FIG. 2 is a sectional view illustrating a lamp unit according to an embodiment.

As shown in FIG. 2, the lamp unit may include a plurality of light sources 100, a plurality of lenses 200, a base plate 400, a spacer 700 and an optical member 600.

The light sources 100 are disposed on the base plate 400 and the base plate 400 may include an electrode pattern to electrically connect the light sources 100.

Additionally, the base plate 400 may have a flexibility and may include a printed circuit board (PCB) substrate formed of a material selected from a group consisting of polyethylene terephthalate (PET), glass, polycarbonate (PC), silicon (Si), polyimide, epoxy and the like, or a film type substrate.

In addition, the base plate 400 may be selected from a group consisting of monolayer PCB, a multilayer PCB, a ceramic substrate, a metal core PCB and the like.

The entirety of the base plate 400 may be formed of one material and a part of the base plate 400 may be formed of a different material as necessary.

For example, the base plate 400 may include a support portion contacting the light source 100 and a connection portion not contacting the light source 100. For example, the support portion and the connection portion of the base plate 400 may be formed of one material.

The support portion and the connection portion may include a base member and a circuit pattern disposed on at least a portion of a surface of the base member, and the base member may be formed of a flexible and insulating material such as polyimide or epoxy (for example, FR-4).

In some cases, the support portion and the connection portion of the base plate 400 may be formed of different materials.

For example, the support portion may be a conductive material and the connection portion may be a non-conductive material.

In addition, the support portion of the base plate 400 may be formed of a hard material not allowing bending so as to support the light source 100 and the connection portion of the base plate 400 may be formed of a ductile material allowing bending so that the base plate 400 is applied to an object having a curvature to be mounted.

In some cases, the base plate 400 may have a configuration in which a circuit pattern for electrical connection is disposed on the light source 100 and a flexible and insulating film is disposed in at least one of upper and lower parts of the circuit pattern.

For example, the film may be formed of a material selected from a group consisting of photosolder resist (PSR), polyimide, epoxy (for example, FR-4) and a combination thereof.

In addition, when the film is disposed in the upper or lower part of the circuit pattern, a film disposed in the upper part of the circuit pattern may be different from a film disposed in the lower part of the circuit pattern.

As such, the base plate 400 may be bent due to use of a ductile material and may be bent due to structural deformation.

Accordingly, the base plate 400 may include a curved surface having one or more curvatures.

Next, the base plate 400 may include a plurality of holes formed respectively in regions corresponding to the connection portions 210 of the lenses 200.

Here, the lens 200 may be coupled to the base plate 400 through the hole of the base plate 400.

Accordingly, the number of holes of the base plate 400 may be equivalent to or greater than the number of lenses 200.

In addition, the base plate 400 may include a plurality of fixing parts which project in a downward direction opposite to the upper surface of the base plate 400 facing the light source 100.

Here, the base plate 400 may be fixed to an object having a curvature to be mounted through the fixing part.

Accordingly, the number of the fixing part may one or more.

In addition, the base plate 400 may include either a reflective coating film or a reflective coating material layer to reflect light generated by the light source 100 toward the optical member 600.

Here, the reflective coating film or the reflective coating material layer may include a metal or metal oxide having high reflectivity such as aluminum (Al), silver (Ag), gold (Au) or titanium dioxide (TiO2).

In some cases, the base plate 400 may be provided with a plurality of heat discharging pins to discharge heat generated by the light source 100.

Next, the light source 100 may be a top view type light emitting diode. In some cases, the light source 110 of a light source module may be a side view type light emitting diode.

Here, the light source 100 may be a light emitting diode (LED) chip, and the light emitting diode chip may be formed as a red LED chip, a blue LED chip or an ultraviolet LED chip or as a package including a combination of at least one of a red LED chip, a green LED chip, a blue LED chip, a yellow green LED chip and a white LED chip.

In addition, the white LED may be implemented by using a yellow phosphor on a blue LED, or using both a red phosphor and a green phosphor on a blue LED, or all of a yellow phosphor, a red phosphor and a green phosphor on a blue LED.

For example, when the lamp unit is applied to a vehicle taillight, the light source 100 may be a vertical-type light emitting chip, for example, a red light emitting chip, but the embodiment is not limited thereto.

Next, the lens 200 may cover the light source 100 and be coupled to the base plate 400.

Here, the lens 200 may include at least one of a connection portion 210 penetrating the base plate 400 and a reinforcement part 220 contacting the spacer 700.

A plurality of connection portions 210 including the extension part may project from an edge of the lower surface of the lenses 200 toward the base plate 400.

In some cases, the connection portion 210 may further include a stopper which is extended from an edge of the lower surface of the lens 200 to the center of the lower surface thereof.

In addition, the connection portion 210 may be disposed in an x-axis direction passing through the center of the lens 200, but the disclosure is not limited thereto.

In some cases, the connection portion 210 may be disposed in an x-axis direction passing through the center of the lens 200 and in a y-axis direction vertical to the x-axis direction.

That is, two connection portions 210 including the connection portion 210 may be symmetrical to each other with respect to the x-axis direction and a total of four connection portions 210 may be symmetrical to one another with respect to both the x-axis direction and the y-axis direction.

In addition, the reinforcement part 220 may project outwardly from a side surface of the lens 200 and may be spaced from the base plate 400 by a predetermined distance.

Here, the reinforcement parts 220 may be disposed in the y-axis direction vertical to the x-axis direction, but the disclosure is not limited thereto.

That is, the reinforcement part 220 may be disposed between the adjacent connection portions 210.

For example, one or more of the reinforcement part 220 may be disposed on the side surface of the lenses 200.

When the two or more reinforcement parts are present, a distance between the reinforcement parts 220 may be identical or different.

In addition, in some cases, the reinforcement part 220 may be disposed so as to surround an entirety of the side surface of the lens 200.

In addition, the reinforcement part 220 may have the lower surface facing the base plate 400. The lower surface of the reinforcement part 220 may be flush with the lower surface of the lens 200.

Additionally, the lens 200 may have a lower surface facing the base plate 400 and the lower surface of the lens 200 may be spaced from the base plate 400 by a predetermined distance.

Here, the lens 200 may have a lower surface facing the base plate 400 and an upper surface facing the optical member 600. The lower surface of the lens 200 may be a planar surface and the upper surface of the lens 200 may be a curved surface.

The upper surface of the lens 200 may include a groove corresponding to a central region of a light emission surface of the light source 100.

In some cases, the lower surface of the lens 200 facing the light source 100 may include a groove.

Here, a cross-section of the groove may have a trapezoidal shape wherein the top of the cross-section is wider than the bottom thereof. In addition, the groove may have a frusto-conical shape.

As such, the formation of the groove in the lens 200 aims at increasing an orientation angle of light emitted from the light source 100, and the embodiments are not limited thereto and a variety of shapes of lenses may be used.

Meanwhile, the light source 100 may be a light emitting diode (LED) chip and be a light emitting diode package including a light emitting diode chip disposed in a package body.

The lens 200 may be disposed to cover the light source 100 and a variety of structures of lenses 200 may be used according to type of the light source 100.

For example, when the light source 100 is a type in which a light emitting diode (LED) chip is directly disposed on the base plate 400, the lens 200 may be disposed on the base plate 400 so as to cover the light source 100.

Here, the lens 200 may include a groove corresponding to a central region of a light emission surface of the light source 100.

In addition, when the light source 100 is a type of a light emitting diode package including a light emitting diode chip disposed in a package body, the lens 200 may be disposed on the package body so as to cover the light emitting diode chip.

Next, when the light source 100 is a type of a light emitting diode package including a light emitting diode chip disposed in a package body, the lens 200 may be disposed on the base plate 400 so as to cover the entirety of the package body including the light emitting diode chip.

The lens 200 may cover a region of the light emitting diode package, excluding a predetermined portion of the package body.

In some cases, the lens 200 may have a hemi-spherical shape having no groove.

Next, the spacer 700 is disposed between the base plate 400 and the optical member 600 and supports an edge of the optical member 600.

Here, the spacer 700 may include a bottom surface facing the base plate 400 and a side surface extending from an edge of the bottom surface toward the optical member 600.

A groove corresponding to the reinforcement part 220 of the lens 200 may be formed on the bottom surface of the spacer 700.

Here, a shape of the groove of the spacer 700 may have the same as or different from that of the reinforcement part 220 of the lens 200.

In addition, holes exposing the upper surface of the lens 200 may be respectively disposed in regions corresponding to the lenses on the bottom surface of the spacer 700.

The number of holes of the spacer 700 may be equivalent to or greater than the number of the lenses 200, but the disclosure is not limited thereto.

In addition, the bottom surface of the spacer 700 may be spaced from the base plate 400 by a predetermined distance d1.

However, in some cases, the bottom surface of the spacer 700 may contact the base plate 400.

Next, the bottom surface of the spacer 700 may be a curved surface having one or more curvatures.

In addition, the side surface of the spacer 700 may be inclined with respect to the bottom surface of the spacer 700.

In addition, the spacer 700 may be formed as either a reflective coating film or a reflective coating material layer and reflect light generated by the light source 100 toward the optical member 600.

Here, the reflective coating film or the reflective coating material layer may contain a metal or metal oxide having a high reflectivity, such as aluminum (Al), silver (Ag), gold (Au) or titanium dioxide (TiO2).

Next, the optical member 600 may be spaced from the base plate 400 via a gap corresponding to a predetermined distance and a light mixing area 750 may be formed in the gap between the base plate 400 and the optical member 600.

Here, the optical member 600 may be spaced from the base plate 400 by a predetermined distance d2 and the distance d2 may be about 10 mm or more.

When the distance d2 between the optical member 600 and the base plate 400 is about 10 mm or less, the lamp unit does not exhibit uniform luminance, and a hot spot phenomenon wherein intensive luminance is generated in a region in which the light source 100 is disposed, or a dark spot phenomenon wherein weaker luminance is generated in a region in which the light source 100 is disposed may occur.

In addition, the optical member 600 may include at least one sheet selected from a diffusion sheet, a prism sheet, a luminance-enhancing sheet and the like.

Here, the diffusion sheet diffuses light emitted from the light source 100, the prism sheet guides diffused light to a light emitting area and the luminance diffusion sheet enhances luminance.

For example, the diffusion sheet is generally formed of an acrylic resin, but the disclosure is not limited thereto. Furthermore, the material for the diffusion sheet includes light-diffusing materials such as polystyrene (PS), poly (methyl methacrylate) (PMMA), cycloolefin copolymers (COCs), polyethylene terephthalate (PET), and highly permeable plastics such as resins.

In addition, the optical member 600 may have an irregular pattern on an upper surface thereof.

The optical member 600 functions to diffuse light from the light source 100, and includes the irregular pattern on the upper surface thereof so as to improve diffusion effects.

That is, the optical member 600 may include a plurality of layers and the irregular pattern may be provided on a surface of the uppermost layer or any layer.

In addition, the irregular pattern may have a stripe shape disposed in one direction.

The irregular pattern has a projection portion disposed on the surface of the optical member 600, the projection portion has a first surface and a second surface which face each other and an angle between the first surface and the second surface may be an obtuse angle or an acute angle.

In some cases, the optical member 600 may include at least two inclined surfaces having at least one inflection point.

In addition, the optical member 600 may include a curved surface having one or more curvatures.

Here, the optical member 600 may have a surface having at least one of a recessed curved surface, a protruded curved surface and a flat planar surface according to outer appearance (shape) of the cover member or the object to be mounted.

Then, a heat discharge member may be disposed under the base plate 400.

Here, the heat discharge member functions to discharge heat generated by the light source 100 to the outside.

For example, the heat discharge member may be formed of a material having high thermal conductivity, for example, aluminum, an aluminum alloy, copper or a copper alloy.

Alternatively, a metal core printed circuit board (MCPCB) in which the base plate 400 integrates with the heat discharge member may be provided and a separate heat discharge member may be further disposed on the lower surface of the MCPCB.

When the separate heat discharge member is bonded to the lower surface of MCPCB, the bonding is carried out through an acrylic adhesive (not shown).

Next, the cover member may further be disposed on the optical member 600.

The cover member protects the base plate 400 including the light source 100 from exterior shock and may be formed of a material (for example, acryl) allowing permeation of light emitted from the light source.

In addition, the cover member may be disposed such that it contacts the optical member 600. Alternatively, one part of the cover member may contact the optical member 600 and the remaining part may be spaced therefrom by a predetermined distance.

In some cases, the entire surface of the cover member facing the optical member 600 may contact the optical member 600.

In addition, the entire surface of the cover member facing the optical member 600 may be spaced from the optical member 600 by a predetermined distance.

The distance between the cover member and the optical member 600 may variably change according to design conditions of light source module required for an object mounted so as to provide overall uniform luminance.

As such, in accordance with the present embodiment, a surface light source is implemented using a small number of light sources by forming a light mixing area 750 between the lens 200 covering the light source 100, the base plate 400 and the optical member 600.

Here, the surface light source means a light source which includes a light emission area diffusing light in a planar form. The embodiment may provide a lamp unit which implements the surface light source with a small number of light sources.

In addition, the lamp unit according to the present embodiment may be applied to objects having a variety of shapes including a curved shape, because the bendable base plate 400 may be coupled to the lenses 200 covering the light sources 100.

Accordingly, the present embodiment improves economic efficiency and freedom of product design of the lamp unit.

Figure 3A:
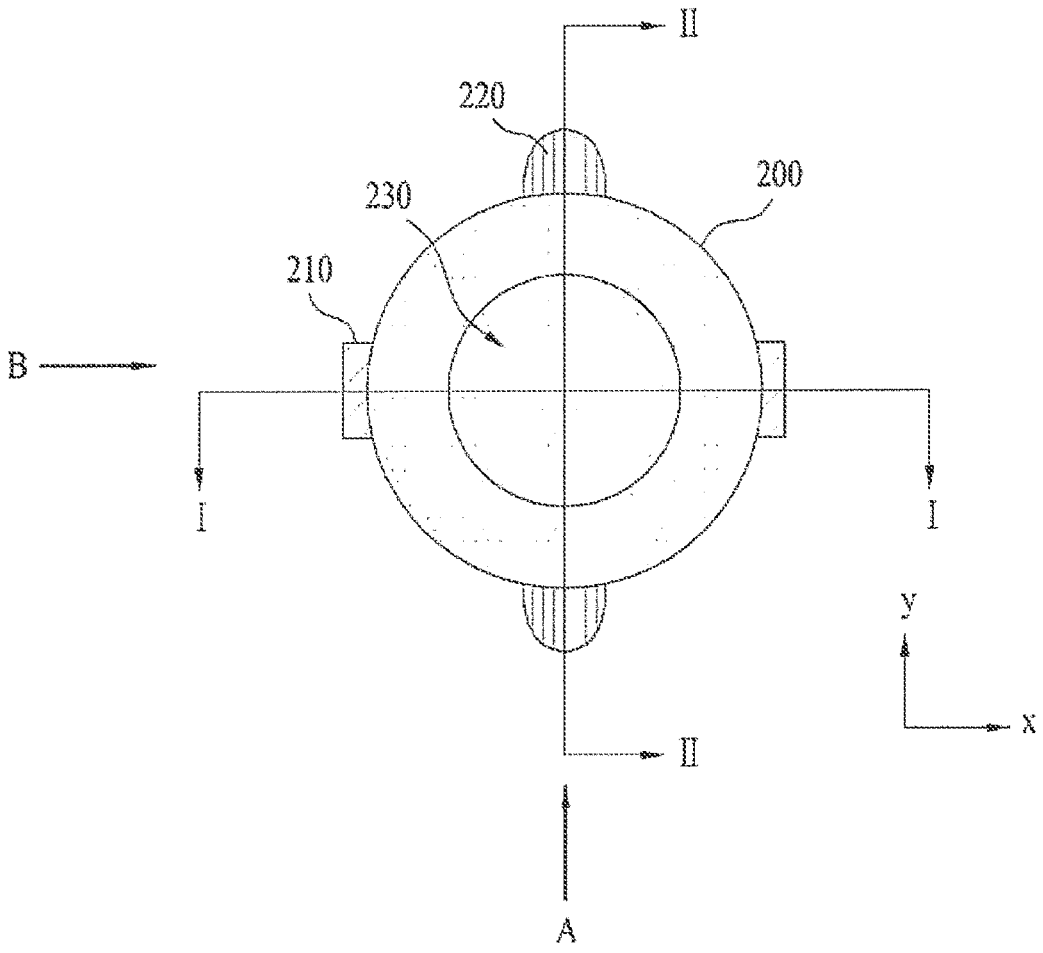
FIG. 3A is a plan view of the lens of FIG. 2.
Figure 3B:
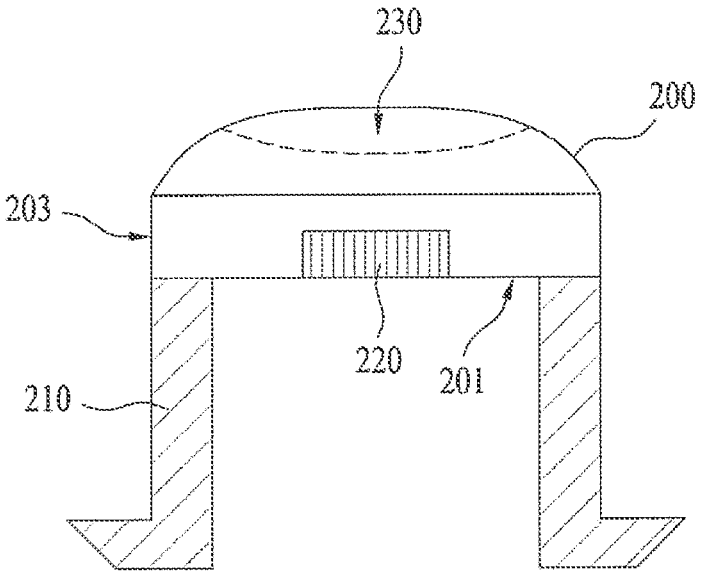
FIG. 3B is a side view seen in a direction A of FIG. 3A.
Figure 3C:
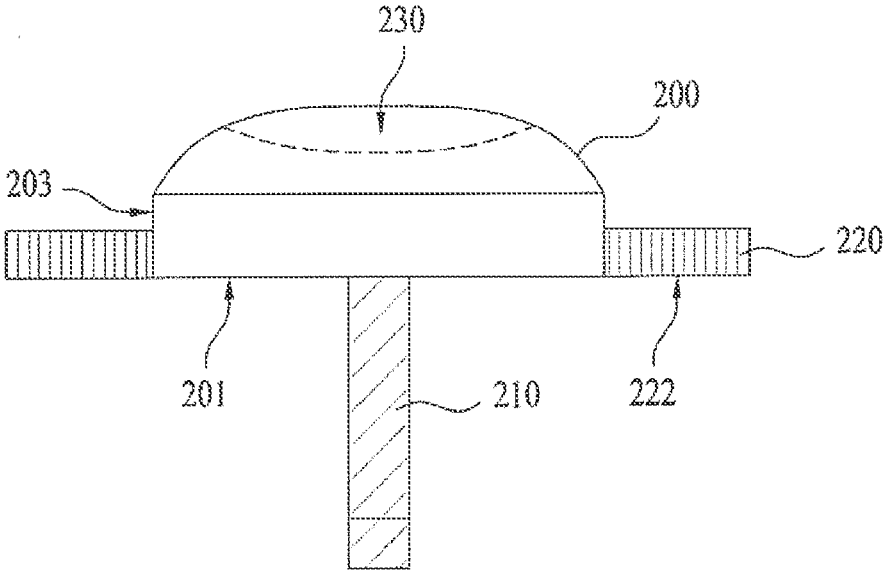
FIG. 3C is a side view seen in a direction B of FIG. 3A.

FIGS. 3A to 3C are views illustrating the lens shown in FIG. 2. More specifically, FIG. 3A is a plan view of the lens of FIG. 2, FIG. 3B is a side view seen in a direction A of FIG. 3A and FIG. 3C is a side view seen in a direction B of FIG. 3A.

As shown in FIGS. 3A to 3C, the lens 200 may include a connection portion 210 and a reinforcement part 220.

Here, a plurality of connection portions 210 including the connection portion 210 may project from an edge of the lower surface 201 facing the base plate (represented by reference numeral "400" in FIG. 2).

In addition, a lower part of the connection portion 210 may have a hook shape.

Accordingly, the connection portion 210 may project from the edge of the lower surface 201 of the lens 20 toward the base plate (represented by reference numeral "400" in FIG. 2) and be coupled to the base plate (represented by reference numeral "400" in FIG. 2).

The connection portion 210 may be disposed in an x-axis direction passing through the center of the lens 200.

For example, when the number of the connection portions 210 is two, the two connection portions 210 may be symmetrical to each other with respect to the x-axis direction.

In addition, the reinforcement part 220 may project outwardly from a side surface 203 of the lens 200.

In addition, the reinforcement part 220 may have a lower surface 222 facing the base plate (represented by reference numeral "400" in FIG. 2). The lower surface 222 of the reinforcement part 220 may be flush with the lower surface 201 of the lens 200.

In some cases, the lower surface 222 of the reinforcement part 220 may not be flush with the lower surface 201 of the lens 200.

The reinforcement part 220 may be disposed in a y-axis direction vertical to the x-axis direction.

For example, when two connection portions 210 including the connection portion 210 are present, they may be symmetrical to each other with respect to the y-axis direction.

Meanwhile, the connection portion 210 may be disposed in the x-axis direction passing through the center of the lens 200, but the disclosure is not limited thereto.

In some cases, the connection portion 210 may be disposed in an x-axis direction passing through the center of the lens 200 and in a y-axis direction vertical to the x-axis direction.

That is, two connection portions 210 including the connection portion 210 may be symmetrical to each other with respect to the x-axis direction and a total of four connection portions 210 may be symmetrical to one another with respect to both the x-axis direction and the y-axis direction.

However, the connection portion 210 may be disposed in a variety of directions, regardless of the x-axis and y-axis directions.

In addition, the reinforcement part 220 may be disposed in the y-axis direction vertical to the x-axis direction, but the disclosure is not limited thereto.

That is, the reinforcement part 220 may be disposed between the adjacent connection portions 210.

For example, one or a plurality of reinforcement parts 220 including the reinforcement part 220 may be disposed on side surface of the lenses 200.

When the plurality of reinforcement parts 220 are present, a distance between the reinforcement parts 220 may be identical or different.

In addition, in some cases, the reinforcement part 220 may be disposed such that it surrounds all side surfaces of the lens 200.

In addition, the lens 200 may include a lower surface 201 facing the base plate 201 (represented by reference numeral "400" in FIG. 2) and an upper surface facing the optical member (represented by reference numeral "600" in FIG. 2).

The lower surface of the lens 200 may be a flat planar surface and the upper surface of the lens 200 may be a curved surface.

The upper surface of the lens 200 may include a groove corresponding to a central region of a light emission surface of the light source (represented by reference numeral "100" in FIG. 2).

As such, the formation of the groove in the lens 200 aims at increasing an orientation angle of light emitted from the light source (represented by reference numeral "100" in FIG. 2).

The lens 200 may be disposed to cover the light source and a variety of structures of lenses 200 may be used according to type of the light source.

For example, when the light source is a type in which a light emitting diode (LED) chip is directly disposed on the base plate, the lens 200 may be disposed on the base plate so as to cover the light source.

Here, the lens 200 may include a groove corresponding to a central region of a light emission surface of the light source.

When the light source is a type of a light emitting diode package including a light emitting diode chip disposed in a package body, the lens 200 may be disposed on the package body so as to cover the light emitting diode chip.

When the light source is a type of a light emitting diode package including a light emitting diode chip disposed in a package body, the lens 200 may be disposed on the base plate 400 so as to cover the entirety of the package body including the light emitting diode chip.

The lens 200 may cover a region of the light emitting diode package, excluding a predetermined portion of the package body.

In some cases, the lens 200 may have a hemi-spherical shape having no groove.

Figure 4A:
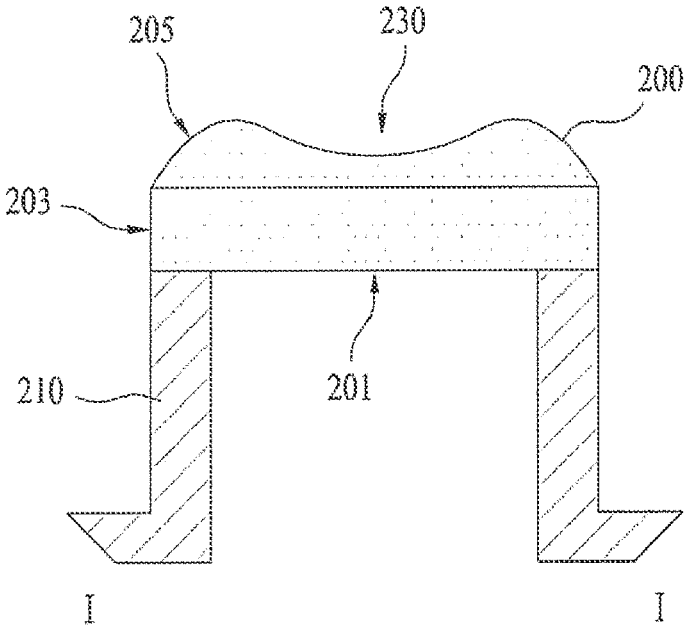
FIG. 4A is a sectional view taken along the line I-I of FIG. 3A
Figure 4B:
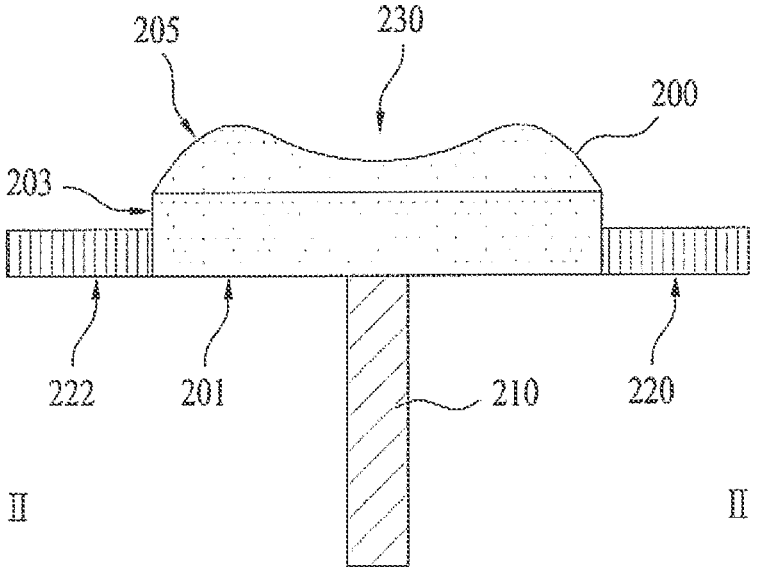
FIG. 4B is a sectional view taken along the line I-II of FIG. 3A.

FIG. 4A is a sectional view taken along the line I-I of FIG. 3A and FIG. 4B is a sectional view taken along the line II-II of FIG. 3A.

As shown in FIGS. 4A and 4B, the lens 200 may include the connection portion 210 and the reinforcement part 220 and the connection portion 210 may project from an edge of the lower surface 201 of the lens 200.

In addition, the lower part of the connection portion 210 may have a hook shape.

Next, the reinforcement part 220 may project outwardly from a side surface 203 of the lens 200 and the lower surface 222 of the reinforcement part 220 may be flush with the lower surface 201 of the lens 200.

In addition, the lower surface 201 of the lens 200 may be a flat planar surface and the upper surface 205 of the lens 200 may be a curved surface.

Here, a groove 230 may be formed in a central region of the upper surface 205 of the lens 200.

An area of an upper part of the groove 230 of the lens 200 may be greater than that of a lower part thereof.

Figure 5A:
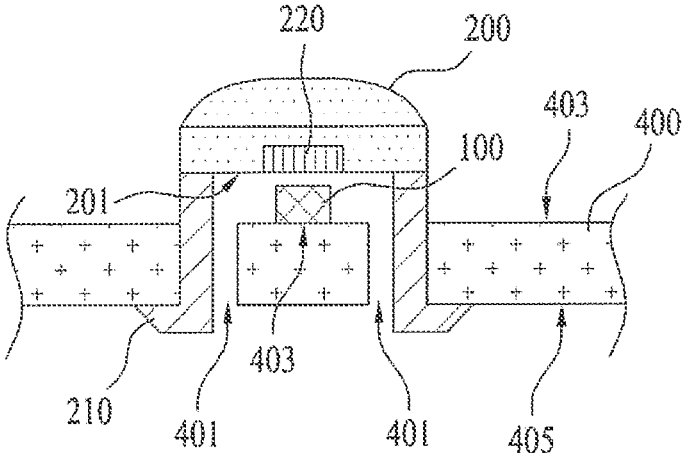
FIGS. 5A and 5B are sectional views illustrating a lens coupled to a base plate.
Figure 5B:
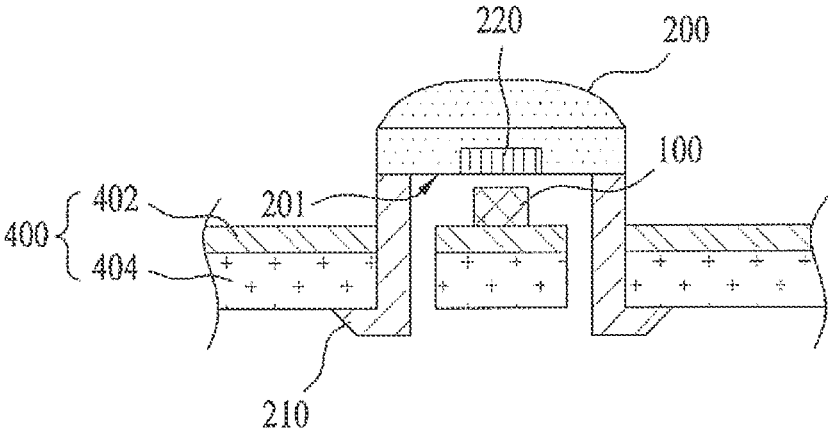

FIGS. 5A and 5B are sectional views illustrating a lens coupled to a base plate, FIG. 5A is a sectional view illustrating a base plate having a monolayer structure and FIG. 5B is a sectional view illustrating a base plate having a multilayer structure.

As shown in FIGS. 5A and 5B, a light source 100 is disposed on an upper surface 403 of the base plate 400 and a hole 401 is disposed in the base plate 400 adjacent to the light source 100.

In addition, the connection portion 210 of the lens 200 is inserted into the hole 401 of the base plate 400 and is thus coupled to the base plate 400.

Here, the hook disposed in a lower part of the connection portion 210 of the lens 200 may contact a lower surface 405 of the base plate 400.

Next, the lower surface 201 of the lens 200 faces the light source 100 and the base plate 400.

Here, the lower surface 201 of the lens 200 may be a flat planar surface and the upper surface 205 of the lens 200 may be a curved surface.

Next, the reinforcement part 220 may project outwardly from a side surface 203 of the lens 200.

Here, the lower surface of the reinforcement part 220 may be flush with the lower surface 201 of the lens 200.

In addition, the base plate 400 may be a monolayer as shown in FIG. 5A and may be a multilayer, as shown in FIG. 5B.

For example, the base plate 400 may include a substrate 402 having a circuit pattern and a support member 404 supporting the substrate 402.

Here, a material for the support member 404 may be a flexible and insulating film containing, for example, polyimide or epoxy (for example, FR-4).

Figure 6:
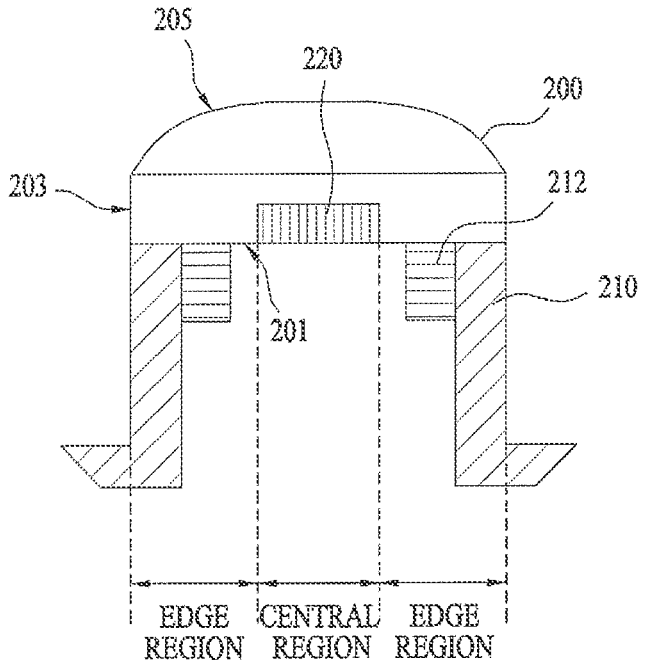
FIG. 6 is a sectional view illustrating a lens including a stopper.
Figure 7:
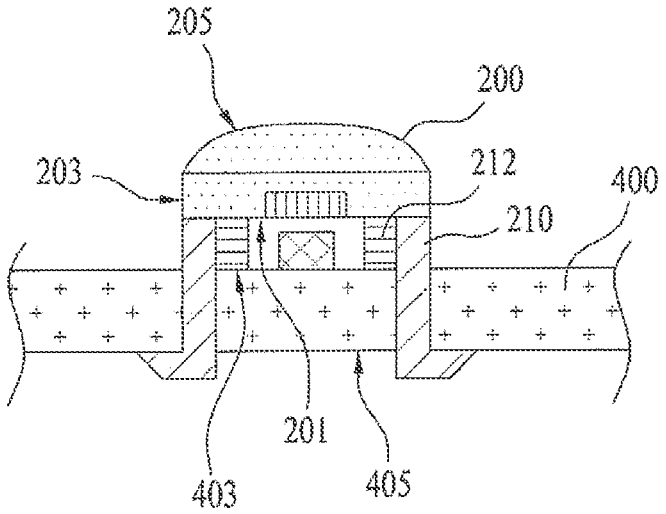
FIG. 7 is a sectional view illustrating the lens of FIG. 6 coupled to the base plate.

FIG. 6 is a sectional view illustrating a lens including a stopper and FIG. 7 is a sectional view illustrating the lens of FIG. 6 coupled to the base plate.

As shown in FIGS. 6 and 7, the lens 200 may include the connection portion 210 and the reinforcement part 220, and the connection portion 210 may project from an edge of the lower surface 201 of the lens 200.

In addition, a lower part of the connection portion 210 may have a hook shape.

Next, the reinforcement part 220 may project outwardly from the side surface 203 of the lens 200 and the lower surface 222 of the reinforcement part 220 may be flush with the lower surface 201 of the lens 200.

Next, the connection portion 210 may include a stopper 212 which projects from an edge of the lower surface 201 of the lens 200 to a central region of the lower surface 201 of the lens 200.

Here, the stopper 212 may contact the upper surface 403 of the base plate 400 when the lens 200 is coupled to the base plate 400.

Accordingly, the stopper 212 maintains a predetermined distance between the lower surface 201 of the lens 200, and the base plate 400 and the light source 100 so that the lower surface 201 of the lens 200 does not contact the base plate 400 and the light source 100.

The stopper 212 prevents the lens 200 from contacting the light source 100 and thus prevents damage of the light source 100 from exterior shock.

Figure 8:
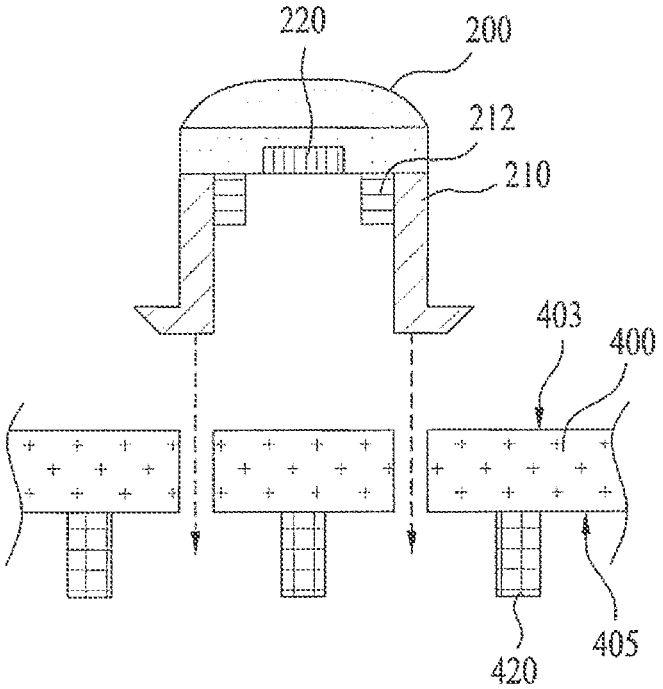
FIG. 8 is a sectional view illustrating a fixing part of the base plate.

FIG. 8 is a sectional view illustrating the fixing part of the base plate.

As shown in FIG. 8, the base plate 400 includes a hole enabling bonding to the lens 200 and a fixing part 420 which projects in a downward direction opposite to the upper surface 403 facing the light source.

Here, the base plate 400 may be fixed on an object having a curvature to be mounted, through the fixing part 420.

In addition, the connection portion 210 of the lens 200 may project from the lower surface of the lens 200 and may be inserted into the hole of the base plate 400.

Next, the reinforcement part 220 may project outwardly from the side surface 203 of the lens 200 and the lower surface of the reinforcement part 220 may be flush with the lower surface 201 of the lens 200.

Next, the connection portion 210 may include a stopper 212 which projects from an edge of the lower surface 201 of the lens 200 to a central region of the lower surface 201 of the lens 200.

Here, the stopper 212 may contact the upper surface 403 of the base plate 400 when the lens 200 is coupled to the base plate 400.

Accordingly, the stopper 212 maintains a predetermined distance between the lower surface 201 of the lens 200, and the base plate 400 and the light source 100 so that the lower surface 201 of the lens 200 does not contact the base plate 400 and the light source 100.

Figure 9A:
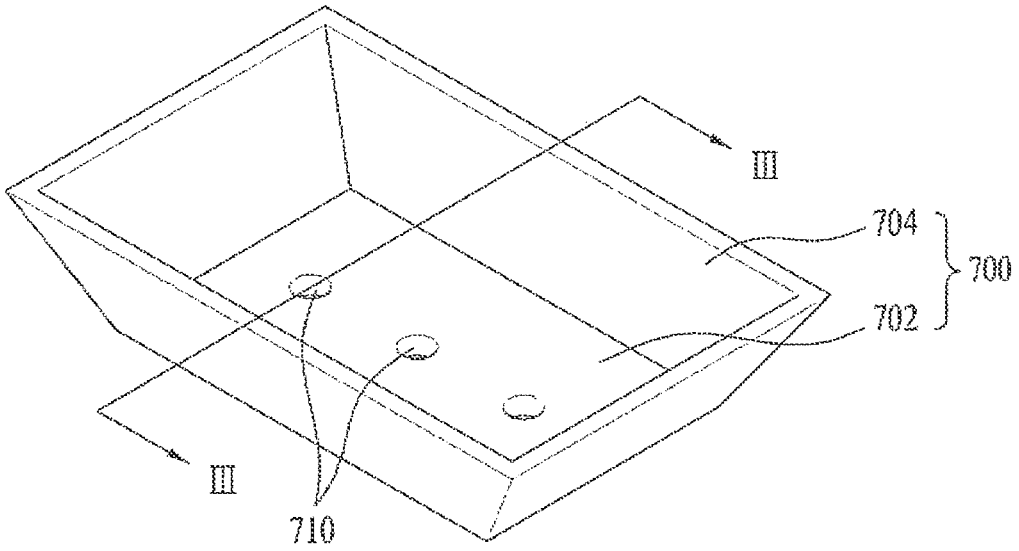
FIG. 9A is a perspective view illustrating a spacer.
Figure 9B:
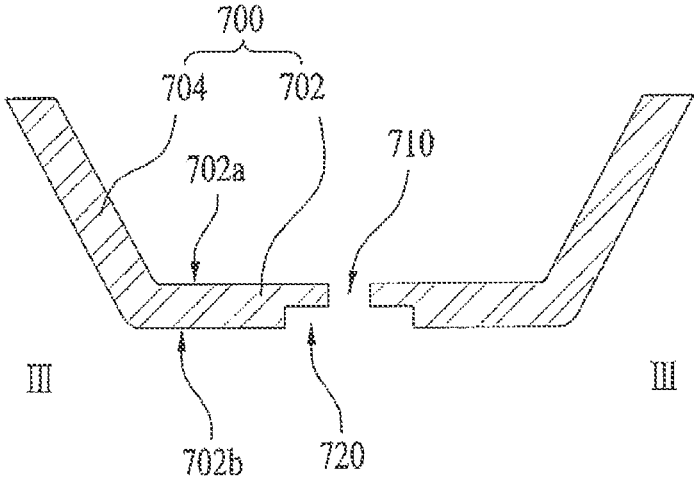
FIG. 9B is a sectional view taken along the line III-III of FIG. 9A.

FIG. 9A is a perspective view illustrating a spacer and FIG. 9B is a sectional view taken along the line III-III of FIG. 9A.

As shown in FIGS. 9A and 9B, the spacer 700 may be disposed between the base plate (represented by reference numeral "400" in FIG. 2) and the optical member (represented by reference numeral "600" in FIG. 2) and support the optical member (represented by reference numeral "600" in FIG. 2).

Here, the spacer 700 may include a bottom surface 702 and a side surface 704 extending from an edge of the bottom surface 702 upwardly.

A groove 720 corresponding to the reinforcement part of the lens (represented by reference numeral "200" in FIG. 2) may be disposed on a lower surface 702*b* of the bottom surface 702 of the spacer 700.

In addition, a hole 710 exposing the upper surface of the lens (represented by reference numeral "200" in FIG. 2) may be disposed in a region corresponding to the lens (represented by reference numeral "200" in FIG. 2) on the bottom surface 702 of the spacer 700.

Here, the hole 710 may correspond to the groove 720 of the spacer 700.

In addition, the bottom surface 702 of the spacer 700 may be spaced from the base plate (represented by reference numeral "400" in FIG. 2) by a predetermined distance d1.

However, in some cases, the bottom surface 702 of the spacer 700 may contact the base plate (represented by reference numeral "400" in FIG. 2).

Next, the bottom surface 702 of the spacer 700 may be a curved surface having one or more curvatures.

In addition, the side surface 704 of the spacer 700 may be inclined with respect to the bottom surface 702 of the spacer 700.

In addition, the spacer 700 may be formed as either a reflective coating film or a reflective coating material layer and reflect light generated by the light source (represented by reference numeral "100" in FIG. 2) toward the optical member (represented by reference numeral "600" in FIG. 2).

Figure 10A:
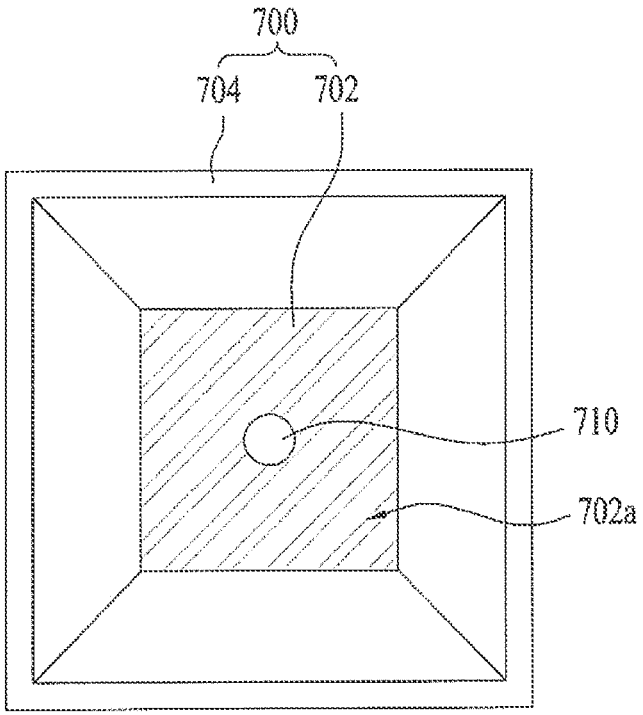
FIG. 10A is a plan view seen from above in FIG. 9B.
Figure 10B:
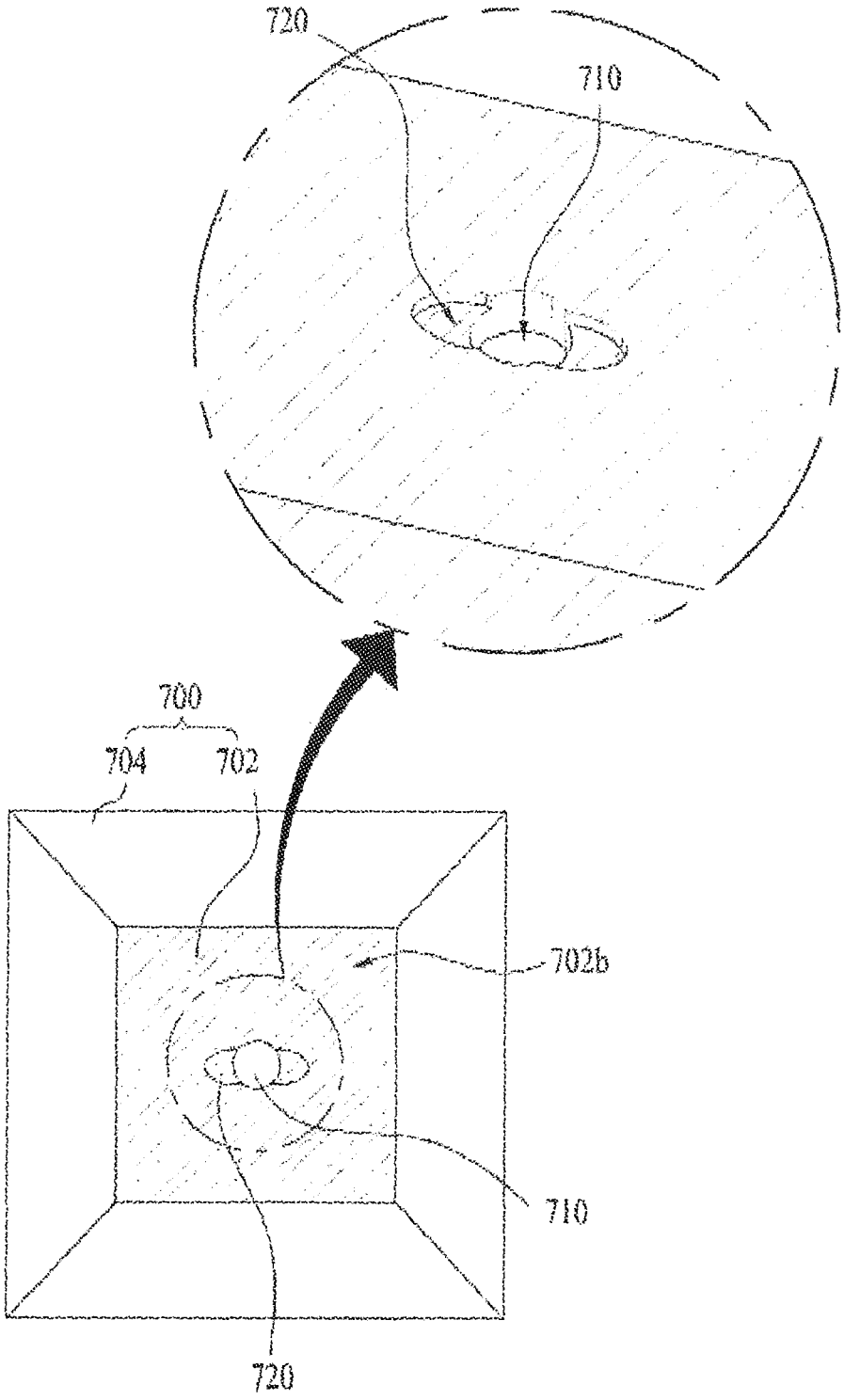
FIG. 10B is a plan view seen from beneath in FIG. 9B.

FIG. 10A is a plan view seen from above in FIG. 9B and FIG. 10B is a plan view seen from beneath in FIG. 9B.

As shown in FIGS. 10A and 10B, the spacer 700 may include the bottom surface 702 and the side surface 704 extending upwardly from an edge of the bottom surface 702. The hole 710 exposing the lens (represented by reference numeral "200" in FIG. 2) may be disposed on an upper surface 702*a* of the bottom surface 702 of the spacer 700.

In addition, the hole 710 allowing insertion of the lens (represented by reference numeral "200" in FIG. 2) may be disposed on the lower surface 702*b* of the bottom surface 702 of the spacer 700 and the groove 720 may be disposed adjacent to the hole 710.

Here, the reinforcement part of the lens (represented by reference numeral "200" in FIG. 2) may be disposed in the groove 720.

Here, a depth of the groove 720 may be equivalent to or greater than that of the reinforcement part of the lens (represented by reference numeral "200" in FIG. 2).

In addition, a plurality of grooves including the groove 720 may be present and the grooves 720 may be disposed symmetrical to one another near the hole 710.

Here, the number of the grooves 720 may be equivalent to that of the reinforcement parts of the lenses (represented by reference numeral "200" in FIG. 2).

Figure 11:
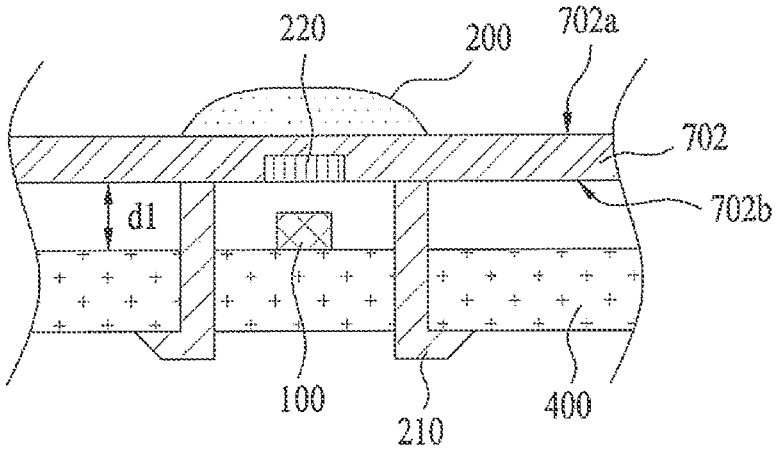
FIG. 11 is a sectional view illustrating a spacer bonded to a lens.

FIG. 11 is a sectional view illustrating a spacer bonded to a lens.

As shown in FIG. 11, the spacer 700 may include a bottom surface 702 facing the base plate 400, the groove may be disposed on the lower surface 702*b* of the bottom surface 702 of the spacer 700 and the reinforcement part 220 of the lens 200 may be inserted into the groove.

In addition, the upper surface of the lens 200 may be exposed to the upper surface 702*a* of the bottom surface 702 of the spacer 700 through the hole disposed in the bottom surface 702 of the spacer 700.

Next, the connection portion 210 of the lens 200 may be inserted into the hole of the base plate 400 and may thus be coupled to the base plate 400.

Here, the lower surface 702*b* of the bottom surface 702 of the spacer 700 may be spaced from the base plate 400 by a predetermined distance d1.

However, in some cases, the lower surface 702*b* of the bottom surface 702 of the spacer 700 may contact the base plate 400.

Accordingly, the connection portion 210 of the lens 200 may be a projection enabling coupling to the base plate 400 and the reinforcement part 220 of the lens 200 may be a projection fixed through the groove of the bottom surface 702 of the spacer 700.

Figure 12:
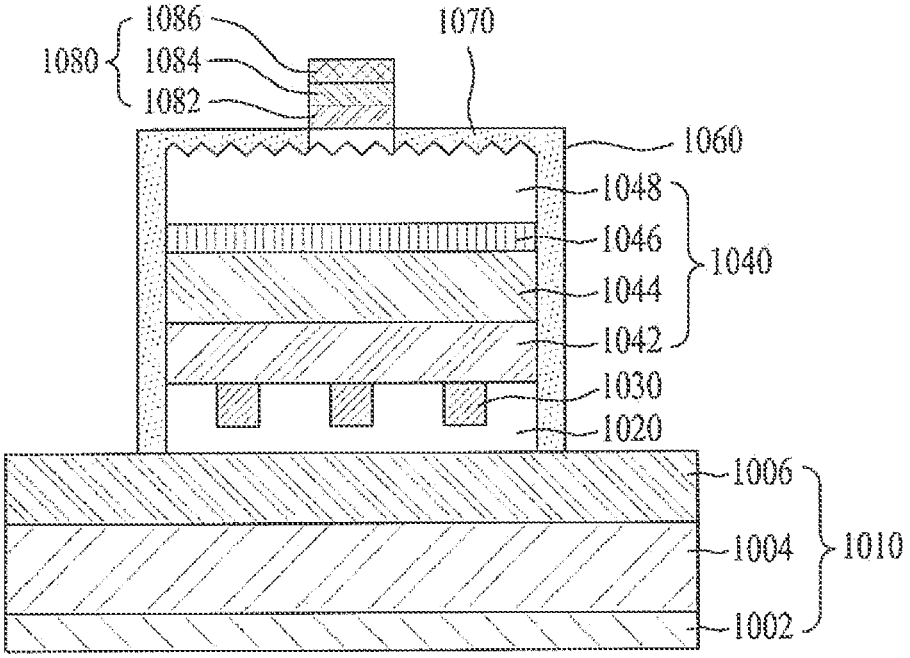
FIG. 12 is a sectional view illustrating the light source of FIG. 2 in detail.

FIG. 12 is a sectional view illustrating the light source of FIG. 2 in detail.

As shown in FIG. 12, the light source 100 may be a vertical light emitting chip having a wavelength range of about 390 to 490 nm.

The light source 100 may include a second electrode layer 1010, a reflective layer 1020, a light emitting structure 1040, a passivation layer 1060 and a first electrode layer 1080.

Here, the second electrode layer 1010 and the first electrode layer 1080 may supply power to the light emitting structure 1040.

In addition, the second electrode layer 1010 may include an electrode material layer 1002 for current injection, a support layer 1004 disposed on the electrode material layer 1002 and a bonding layer 1006 disposed on the support layer 1004.

Here, the electrode material layer 1002 may be formed of Ti/Au and the support layer 1004 may be formed of a metal or a semiconductor material.

In addition, the support layer 1004 may be formed of a material having high electrical conductivity and thermal conductivity. For example, the support layer 1004 may be formed of a metal material including at least one of copper (Cu), a copper alloy (Cu alloy), gold (Au), nickel (Ni), molybdenum (Mo) and copper-tungsten (Cu—W) or a semiconductor including at least one of Si, Ge, GaAs, ZnO and SiC.

Next, the bonding layer 1006 may be disposed between the support layer 1004 and the reflective layer 1020 and function to bond the support layer 1004 to the reflective layer 1020.

Here, the bonding layer 1006 may include a bonding metal material, for example, at least one of In, Sn, Ag, Nb, Pd, Ni, Au and Cu.

The bonding layer 1006 is formed to bond the support layer 1004 by a bonding method and may be omitted when the support layer 1004 is formed by plating or deposition.

In addition, the reflective layer 1020 is disposed on the bonding layer 1006 and the reflective layer 1020 reflects light emitted from the light emitting structure 1040 and thereby improves light extraction efficiency.

Here, the reflective layer 1020 may be formed of a metal or alloy including, as a reflecting metal material, for example, at least one of Ag, Ni, Al, Rh, Pd, Ir, Ru, Mg, Zn, Pt, Au and Hf.

In addition, the reflective layer 1020 may be formed to have a monolayer or multilayer structure using a conductive oxide layer, for example, indium zinc oxide (IZO), Indium zinc tin oxide (IZTO), indium aluminum zinc oxide (IAZO), indium gallium zinc oxide (IGZO), indium gallium tin oxide (IGTO), aluminum zinc oxide (AZO), antimony tin oxide (ATO) or the like.

In some cases, the reflective layer 1020 may be formed to have a multilayer structure using a combination of a metal and conductive oxide such as IZO/Ni, AZO/Ag, IZO/Ag/Ni, or AZOIAg/Ni.

Next, an ohmic region 1030 may be disposed between the reflective layer 1020 and the light emitting structure 1040.

Here, the ohmic region 1030 is an area which ohmic-contacts the light emitting structure 1040 and functions to facilitate supply of power to the light emitting structure 1040.

The ohmic region 1030 may include a material ohmic-contacting the light emitting structure 1040, for example, at least one of Be, Au, Ag, Ni, Cr, Ti, Pd, Ir, Sn, Ru, Pt and Hf.

For example, the ohmic region 1030 may include AuBe and may have a dot shape.

Next, the light emitting structure 1040 may include a window layer 1042, a second semiconductor layer 1044, an active layer 1046 and a first semiconductor layer 1048.

Here, the window layer 1042 is a semiconductor layer disposed on the reflective layer 1020 and contains GaP.

In some cases, the window layer 1042 may be omitted.

Next, the second semiconductor layer 1044 is disposed on the window layer 1042 and the second semiconductor layer 1044 may be implemented with a compound semiconductor such as Group III-V or Group II-VI compound semiconductor and be doped with a second conductive-type dopant.

For example, the first semiconductor layer 1044 may contain at least one of AlGaInP, GaInP, AlInP, GaN, AlN, AlGaN, InGaN, InN, InAlGaN, AlInN, AlGaAs, GaP, GaAs and GaAsP, and be doped with a p-type dopant (for example, Mg, Zn, Ca, Sr, or Ba).

In addition, the active layer 1046 may be disposed between the second semiconductor layer 1044 and the first semiconductor layer 1048 and may emit light by energy generated during recombination between electrons and holes supplied from the second semiconductor layer 1044 and the first semiconductor layer 1048.

Here, the active layer 1046 may be a Group III-V or Group III-VI compound semiconductor and may have a single well structure, a multiple well structure, a quantum-wire structure, a quantum dot structure or the like.

For example, the active layer 1046 may have a single or multiple quantum well structure including a well layer and a barrier layer.

The well layer may be formed of a material having an energy band gap lower than that of the barrier layer and the active layer 1046 may be for example AlGaInP or GaInP.

Next, the first semiconductor layer 1048 may be formed of a semiconductor compound and the first semiconductor layer 1048 may be implemented with a Group III-V or Group II-VI compound semiconductor or the like and may be doped with a first conductive-type dopant.

For example, the first semiconductor layer 1048 may contain at least one of AlGaInP, GaInP, AlInP, GaN, AlN, AlGaN, InGaN, InN, InAlGaN, AlInN, AlGaAs, GaP, GaAs and GaAsP and be doped with an n-type dopant (e.g. Si, Ge or Sn).

In addition, the light emitting structure 1040 may emit blue light having a wavelength range of about 390 to 490 nm and the first semiconductor layer 1048, the active layer 1046 and the second semiconductor layer 1044 may contain a material emitting blue light.

In addition, so as to improve light extraction efficiency, the first semiconductor layer 1048 may have a roughness 1070 on an upper surface thereof.

Next, the passivation layer 1060 is disposed on a side surface of the light emitting structure 1040 and the passivation layer 1060 electrically protects the light emitting structure 1040.

Here, the passivation layer 1060 may be formed of an insulating mateterial, for example, SiO2, SiOx, SiOxNy, Si3N4, or Al2O3.

In some cases, the passivation layer 1060 may be disposed only in at least part of the upper surface of the first semiconductor layer 1048.

In addition, the first electrode layer 1080 may be disposed on the first semiconductor layer 1048 and may have a predetermined pattern.

Here, the first electrode layer 1080 may have a monolayer or multilayer structure and for example, the first electrode layer 1080 may include a first layer 1082, a second layer 1084 and a third layer 1086 laminated in this order.

The first layer 1082 ohmic-contacts the first semiconductor layer 1048 and contains GaAs.

In addition, the second layer 1084 may be formed of an AuGe/Ni/Au alloy and the third layer 1086 may be formed of a Ti/Au alloy.

A phosphor layer including one or more of phosphors having a wavelength range of about 550 to 700 nm is disposed on the light source having the structure described above to emit light having a color of a square area determined by color coordinates (0.54, 0.37), (0.54, 0.45), (0.61, 0.45) and (0.61, 0.37) in a CIE chromaticity diagram.

Accordingly, the first electrode layer 1080 of the light source may be closer to the phosphor layer than the second electrode layer 1010.

FIGS. 13A to 13D are sectional views illustrating an irregular pattern of the optical member.

As shown in FIGS. 13A to 13D, the optical member 600 diffuses light emitted from the light source and may have an irregular pattern 610 on an upper surface thereof to improve diffusion effects.

Here, the irregular pattern 610 may have a strip shape disposed in one direction.

Figure 13A:
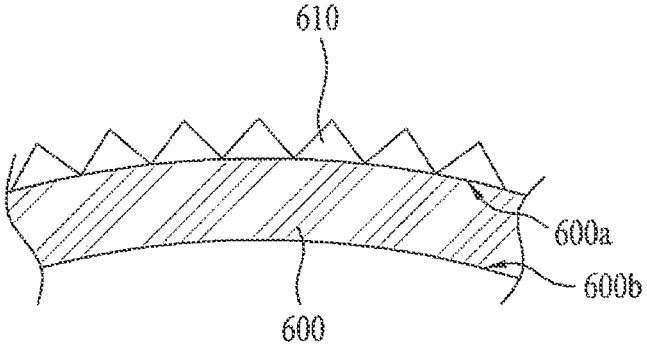
FIGS. 13A to 13D are sectional views illustrating an irregular pattern of an optical member.

In addition, as shown in FIG. 13A, the irregular pattern 610 of the optical member 600 may be disposed on the upper surface 600*a* of the optical member 600 and the upper surface 600*a* of the optical member 600 may face a cover member (not shown).

When the optical member 600 has a multilayer structure, the irregular pattern 610 may be disposed on the surface of the uppermost layer.

Figure 13B:
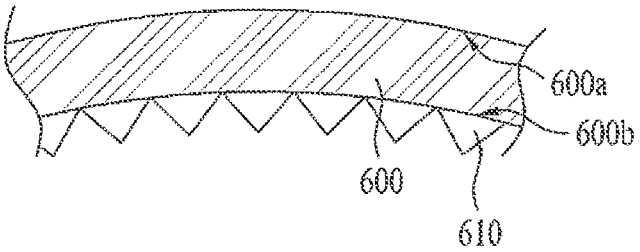

Next, as shown in FIG. 13B, the irregular pattern 610 of the optical member 600 may be disposed on a lower surface 600*b* of the optical member 600 and the lower surface 600*b* of the optical member 600 may face a light module (not shown).

When the optical member 600 has a multilayer structure, the irregular pattern 610 may be disposed on the surface of the lowermost layer.

Figure 13C:
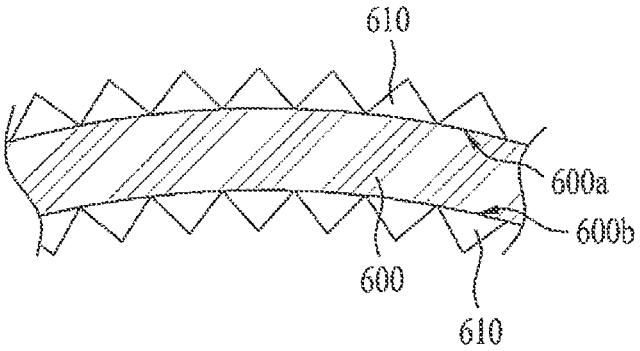

As shown in FIG. 13C, the irregular pattern 610 of the optical member 600 may be disposed on the upper surface 600*a* of the optical member 600 and on the lower surface 600*b* of the optical member 600. When the optical member 600 has a multilayer structure, the irregular pattern 610 may be disposed both on the surface of the uppermost layer of the optical member 600 and on the surface of the lowermost layer thereof.

Figure 13D:
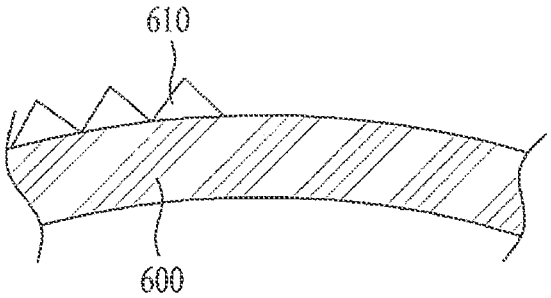

In addition, as shown in FIG. 13D, the irregular pattern 610 of the optical member 600 may be disposed in a portion of the upper surface 600*a* of the optical member 600 or a portion of the lower surface 600*b* of the optical member 600.

The irregular pattern has a projection which bulges from the surface of the optical member 600, the projection has a first surface and a second surface which face each other and an angle between the first surface and the second surface may be an obtuse angle or an acute angle.

In some cases, the irregular pattern may a recessed groove in the surface of the optical member 600, the groove has a third surface and a fourth surface which face each other and an angle between the third surface and the fourth surface may be an obtuse angle or an acute angle.

As such, the irregular pattern 610 of the optical member 600 may variably change according to design conditions of light source module required for an object mounted so as to provide overall uniform luminance.

Figure 14A:
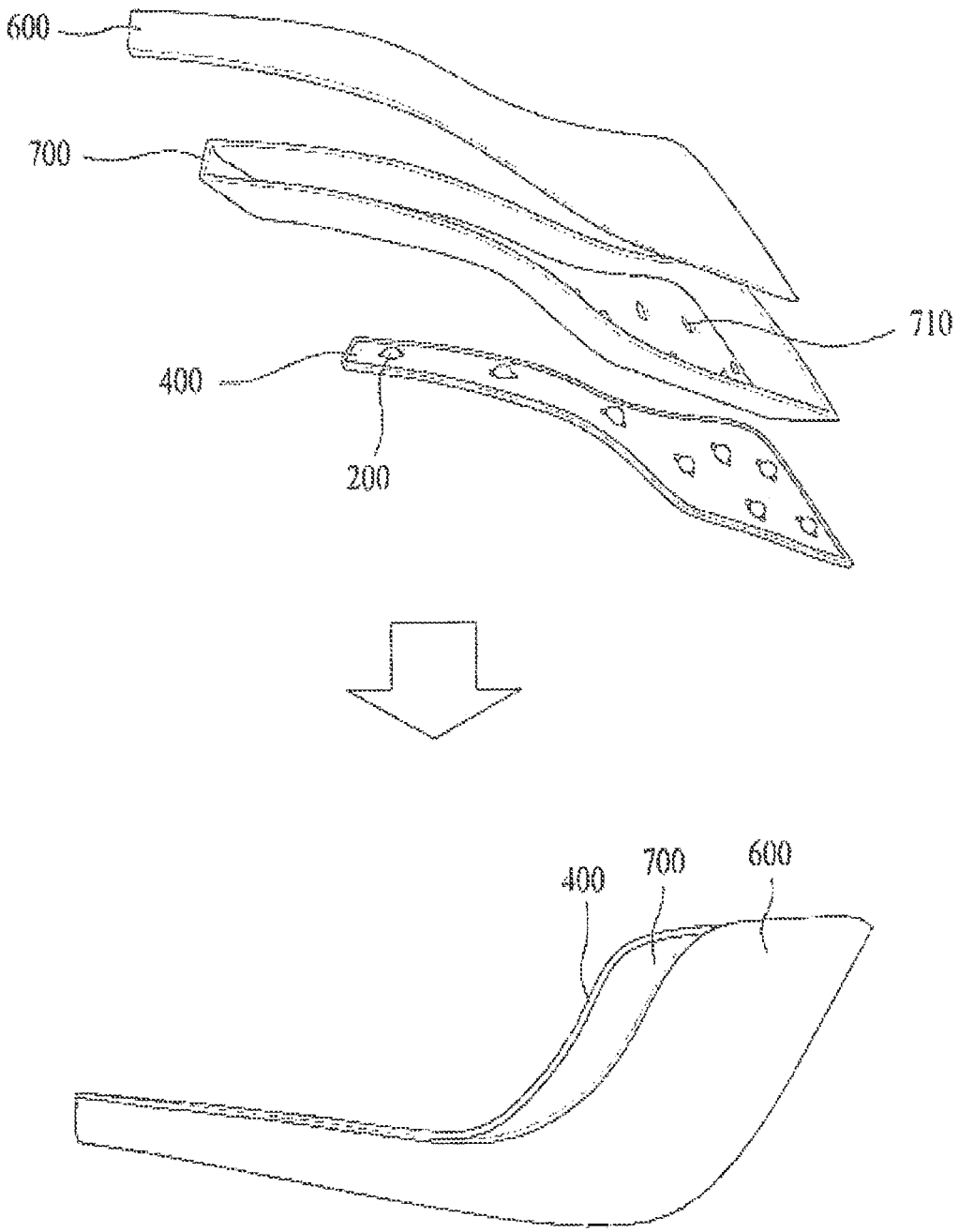
FIGS. 14A to 14C are exploded views illustrating a vehicle lamp unit according to an embodiment.
Figure 14B:
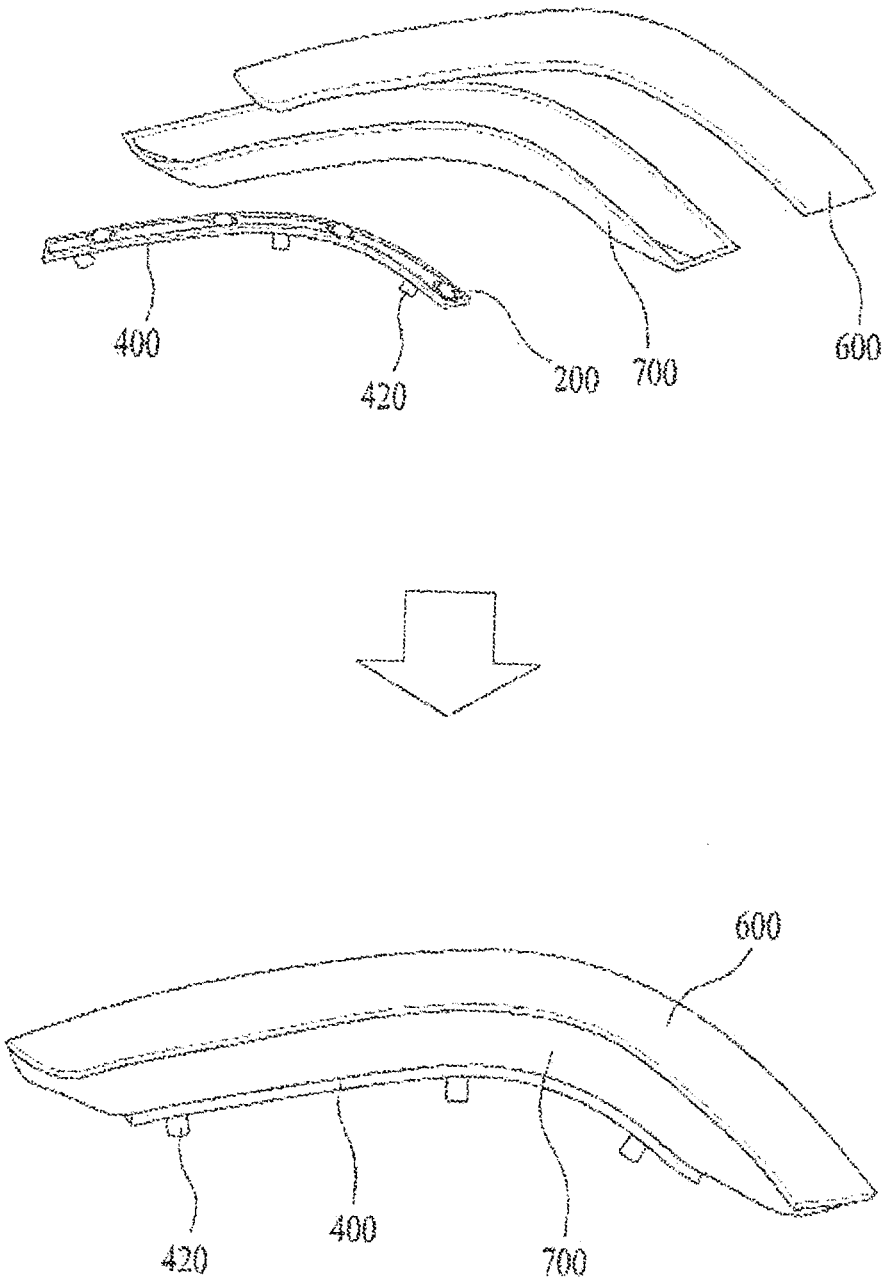
Figure 14C:
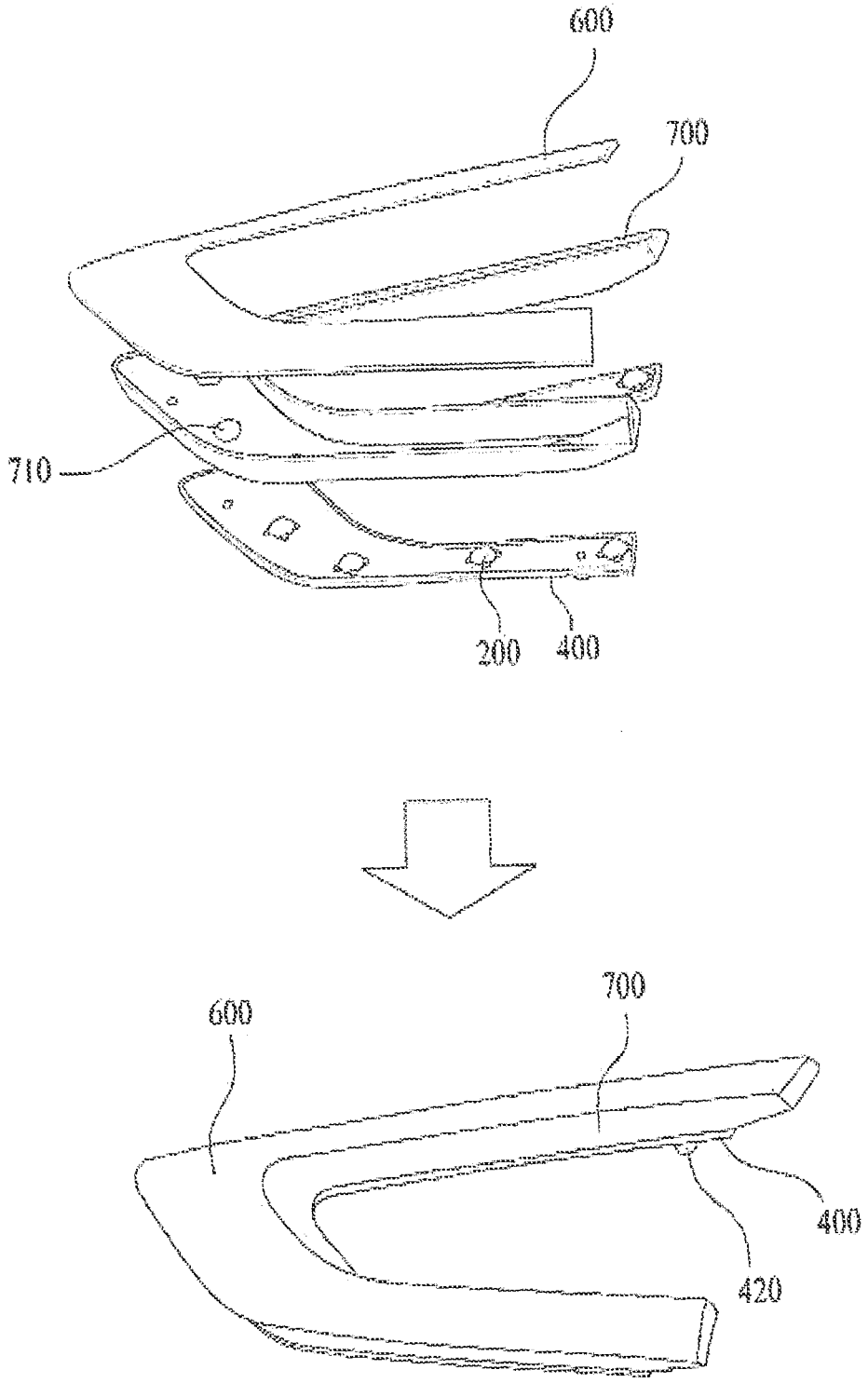

FIGS. 14A to 14C are exploded views illustrating a vehicle lamp unit according to an embodiment.

As shown in FIGS. 14A to 14C, the vehicle lamp unit may include a base plate 400 having a plurality of lenses 200 covering a plurality of light sources, a spacer 700 and an optical member 600.

Here, the light sources may be disposed on the base plate 400 and the base plate 400 may include an electrode pattern to electrically connect the light sources.

Additionally, the base plate 400 may have a flexibility and may be a printed circuit board (PCB) substrate formed of a material selected from polyethylene terephthalate (PET), glass, polycarbonate (PC), silicon (Si), polyimide, epoxy and the like, or a film type substrate.

In addition, the base plate 400 may be selected from a monolayer PCB, a multilayer PCB, a ceramic substrate, a metal core PCB and the like.

As such, the base plate 400 may be bent due to use of a ductile material and may be bent due to structural deformation.

Accordingly, the base plate 400 may include a curved surface having one or more curvatures.

Next, the base plate 400 may include a plurality of holes formed respectively in regions corresponding to the connection portions 210 of respective lenses 200.

Here, the lens 200 may be coupled to the base plate 400 through the hole of the base plate 400.

In addition, the base plate 400 may include a plurality of fixing parts 420 which project in a downward direction opposite to the upper surface of the base plate 400 facing the light source 100.

Here, the base plate 400 may be fixed on an object having a curvature to be mounted through the fixing part.

In addition, the base plate 400 may include either a reflective coating film or a reflective coating material layer to reflect light generated by the light source 100 toward the optical member 600.

Here, the reflective coating film or the reflective coating material layer may include a metal or metal oxide having high reflectivity such as aluminum (Al), silver (Ag), gold (Au) or titanium dioxide (TiO2).

In some cases, the base plate 400 may be provided with a plurality of heat discharging pins to discharge heat generated by the light source 100.

Here, the light source 100 may be a light emitting diode (LED) chip, and the light emitting diode chip may be formed as a red LED chip, a blue LED chip or an ultraviolet LED chip or as a package including a combination of at least one of a red LED chip, a green LED chip, a blue LED chip, a yellow green LED chip and a white LED chip.

For example, when the lamp unit is applied to a vehicle taillight, the light source 100 may be a vertical-type light emitting chip, for example, a red light emitting chip, but the embodiment is not limited thereto.

Next, the lens 200 may cover the light source 100 and be coupled to the base plate 400.

Here, the lens 200 may include a connection portion contacting the base plate 400 and a reinforcement part contacting the spacer 700.

The connection portion 210 may project from an edge of the lower surface of the lenses 200 toward the base plate 400.

In some cases, the connection portion may further include a stopper which projects from the edge of the lower surface of the lens 200 toward the center of the lower surface thereof.

In addition, the connection portion may be disposed in an x-axis direction passing through the center of the lens 200.

In addition, the reinforcement part may project outwardly from a side surface of the lens 200 and may be spaced from the base plate 400 by a predetermined distance.

Here, the reinforcement part may be disposed in the y-axis direction vertical to the x-axis direction.

Additionally, the lens 200 may have a lower surface facing the base plate 400 and the lower surface of the lens 200 may be spaced from the base plate 400 by a predetermined distance.

Next, the spacer 700 may be disposed between the base plate 400 and the optical member 600 and support an edge of the optical member 600.

Here, the spacer 700 may include a bottom surface facing the base plate 400 and a side surface extending from an edge of the bottom surface toward the optical member 600.

A groove corresponding to the reinforcement part 220 of the lens 200 may be disposed on the bottom surface of the spacer 700.

In addition, a hole exposing the upper surface of the lens 200 in a region corresponding to the lens may be disposed on the bottom surface of the spacer 700.

In addition, the bottom surface of the spacer 700 may be spaced from the base plate 400 by a predetermined distance d1. However, in some cases, the bottom surface of the spacer 700 may contact the base plate 400.

Next, the bottom surface of the spacer 700 may be a curved surface having one or more curvatures.

In addition, the side surface of the spacer 700 may be inclined with respect to the bottom surface of the spacer 700.

In addition, the spacer 700 may include a reflective coating film or a reflective coating material layer to reflect light generated by the light source 100 toward the optical member 600.

Here, the reflective coating film or the reflective coating material layer may contain a metal or metal oxide having a high reflectivity, such as aluminum (Al), silver (Ag), gold (Au) or titanium dioxide (TiO2).

Next, the optical member 600 may be spaced from the base plate 400 via a gap corresponding to a predetermined distance and a light mixing area 750 may be formed in the gap between the base plate 400 and the optical member 600.

Here, the optical member 600 may be spaced from the base plate 400 by a predetermined distance d2 and the distance d2 may be about 10 mm or more.

When the distance d2 between the optical member 600 and the base plate 400 is about 10 mm or less, the lamp unit does not exhibit uniform luminance, and a hot spot phenomenon wherein intensive luminance is generated in a region in which the light source 100 is disposed, or a dark spot phenomenon wherein weaker luminance is generated in a region in which the light source 100 is disposed may occur.

In addition, the optical member 600 may include at least one selected from a diffusion sheet, a prism sheet, a luminance-enhancing sheet and the like.

Here, the diffusion sheet diffuses light emitted from the light source 100, the prism sheet guides diffused light to a light emitting area and the luminance diffusion sheet enhances luminance.

For example, the diffusion sheet is generally formed of an acrylic resin, but the disclosure is not limited thereto. Furthermore, the material for the diffusion sheet includes light-diffusing materials such as polystyrene (PS), poly (methyl methacrylate) (PMMA), cycloolefin copolymers (COCs), polyethylene terephthalate (PET), and highly-permeable plastics such as resins.

Here, the optical member 600 may have a surface having at least one of a recessed curved surface, a protruded curved surface and a flat planar surface according to outer appearance (shape) of the cover member or the object to be mounted.

As such, in accordance with the embodiment, a surface light source is implemented using a small number of light sources by forming a light mixing area 750 between the lens 200 covering the light source 100, the base plate 400 and the optical member 600.

As such, in accordance with the present embodiment, a surface light source is implemented using a small number of light sources by forming a lens 200 covering the light source 100 and forming a light mixing area 750 between the base plate 400 and the optical member 600.

Here, the surface light source means a light source which includes a light emission area diffusing light in a planar form. The present embodiment may provide a lamp unit which implements a surface light source with a small number of light sources.

In addition, the lamp unit according to the present embodiment may be applied to objects having a variety of shapes including a curved shape, because the bendable base plate 400 may be coupled to the lens 200 covering the light source 100.

Accordingly, the present embodiment improves economic efficiency and freedom of product design of the lamp unit.

Figure 15:
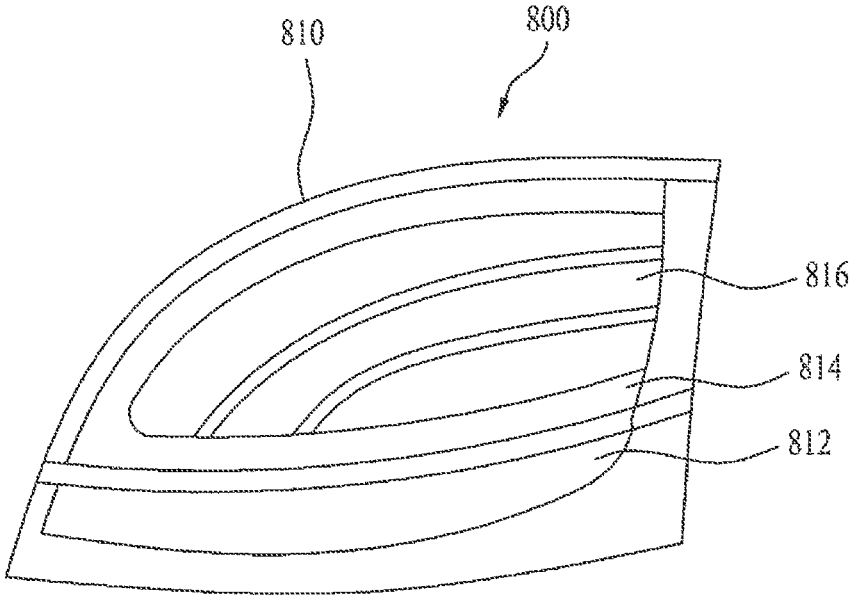
FIG. 15 is a view illustrating a vehicle taillight including a lamp unit according to an embodiment.

FIG. 15 is a view illustrating a vehicle taillight according to an embodiment.

As shown in FIG. 15, the vehicle taillight 800 may include a first lamp unit 812, a second lamp unit 814, a third lamp unit 816 and a housing 810.

Here, the first lamp unit 812 may be a light source serving as a turn signal lamp, the second lamp unit 814 may be a light source serving as a side marker light, and the third lamp unit 816 may be a light source serving as a stop light, but the embodiment is not limited thereto and the functions thereof may be interchanged.

In addition, the housing 810 may accommodate the first to third lamp units 812, 814 and 816, and may be formed of a light-transmitting material.

In this case, the housing 810 may have a curvature suited for the design of the vehicle body and the first to third lamp units 812, 814 and 816 may implement a bendable surface light source according to shape of the housing 810.

Figure 16:
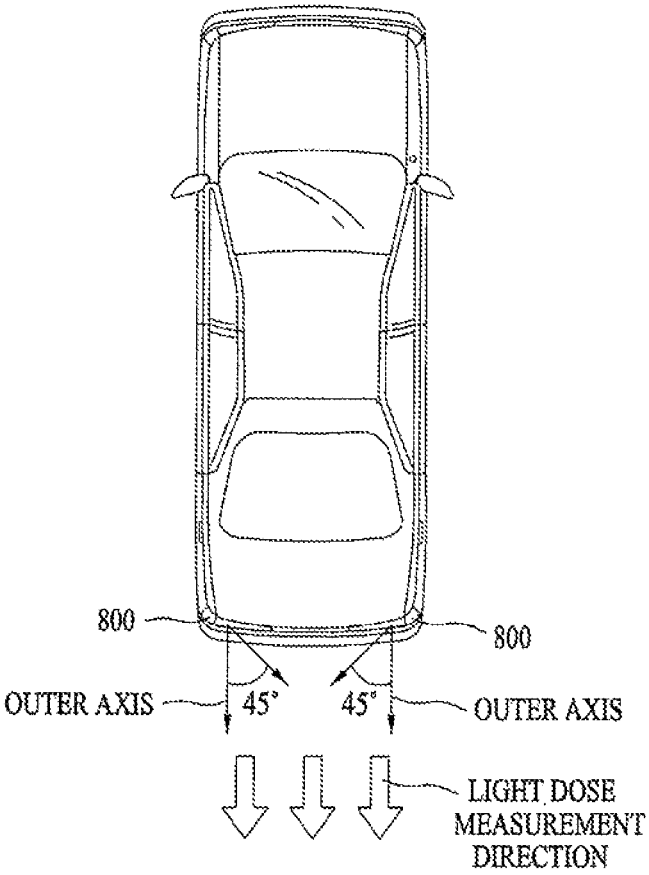
FIG. 16 is a plan view illustrating a vehicle including a lamp unit according to an embodiment.

FIG. 16 is a plan view illustrating a vehicle including a lamp unit according to an embodiment.

As shown in FIG. 16, when the lamp unit is applied to a vehicle taillight, regarding a safety standard of the lamp unit applied to the vehicle taillight, a projection area when seen at a horizontal angle of 45 degrees in an outer axis of the vehicle based on a central point of a light should be about 12.5 sq centimeters or more, for example, luminous intensity of a stop light should be about 4 to 420 candela (cd).

Accordingly, the vehicle taillight should provide a dose of light not lower than a predetermined value, when measured in a light dose measurement direction.

The lamp unit according to the present embodiment improves economical efficiency and freedom of product design of the lamp unit by implementing a surface light source which provides a dose of light not lower than a predetermined value in a predetermined light dose measurement direction even with a small number of light sources.

That is, in accordance with the present embodiment, first, a surface light source is implemented even with a small number of light sources by covering the light sources with lenses.

Second, a lamp unit having low weight may be manufactured at a low cost by forming a light mixing area in a gap between the light source and the optical member without forming a light guide plate.

Third, the lamp unit may be applied to an object having a curvature by disposing a plurality of light sources on a bendable base plate.

Accordingly, economic efficiency and product design freedom of the lamp unit may be improved.

Embodiments provide a lamp unit which implements a source light source with a small number of light sources using a lens and a vehicle lamp apparatus using the same.

Embodiments provide a lamp unit which includes a plurality of light sources disposed on a flexible base plate and is thus applicable to a curved object mounted thereon and a vehicle lamp apparatus using the same.

In one embodiment, a lamp unit includes an optical member, a base plate spaced from the optical member by a predetermined distance, a spacer between the base plate and the optical member, the spacer supporting an edge of the optical member, a light source disposed on the base plate, and a lens coupled to the base plate, the lens covering the light source, wherein the lens comprises a connection portion contacting the base plate and a reinforcement part contacting the spacer.

The connection portion may project from an edge of a lower surface of the lens toward the base plate.

The connection portion may include a stopper which projects from the edge of the lower surface of the lens toward a center of the lower surface of the lens.

The connection portion may be disposed in an x-axis direction passing through the center of the lens and the reinforcement part may be disposed in a y-axis direction vertical to the x-axis direction.

The reinforcement part may project outwardly from a side surface of the lens and be spaced from the base plate by a predetermined distance.

The reinforcement part may include a lower surface facing the base plate and the lower surface of the reinforcement part may be flush with the lower surface of the lens.

The lens may include a lower surface facing the base plate, wherein the lower surface of the lens is spaced from the base plate by a predetermined distance.

The lens may include the lower surface facing the base plate and an upper surface facing the optical member, wherein the lower surface of the lens is a planar surface and the upper surface of the lens is a curved surface.

The upper surface of the lens may include a groove corresponding to a central region of a light emission surface of the light source.

The base plate may include a hole disposed in a region corresponding to the connection portion of the lens and the base plate may include a curved surface having one or more curvatures.

The base plate may include a fixing part projecting in a downward direction opposite to the upper surface of the base plate facing the light source.

The spacer may include a bottom surface facing the base plate and a side surface extending from an edge of the bottom surface toward the optical member.

The bottom surface of the spacer may include a groove corresponding to the reinforcement part of the lens and the bottom surface of the spacer may include a hole to expose the upper surface of the lens in a region corresponding to the lens.

The bottom surface of the spacer may include a curved surface having one or more curvatures and the bottom surface of the spacer may be spaced from the base plate by a predetermined distance.

A side surface of the spacer may be inclined with respect to the bottom surface of the spacer.

The optical member may include a curved surface having one or more curvatures and the optical member may be spaced from the base plate by a distance of 10 mm or more.

The connection portion may be disposed in a direction parallel to the base plate.

The connection portion may be disposed in a direction vertical to the reinforce projection.

A side surface of the spacer may be disposed at an obtuse angle with respect to the bottom surface of the spacer.

In another embodiment, a lamp unit includes an optical member, a base plate spaced from the optical member by a predetermined distance, a spacer between the base plate and the optical member, the spacer supporting an edge of the optical member, a light source disposed on the base plate, and a lens coupled to the base plate, the lens covering the light source, wherein the spacer includes a bottom surface contacting the base plate and a side surface extending from an edge of the bottom surface toward the optical member, wherein the bottom surface of the spacer comprises a hole to expose the upper surface of the lens in a region corresponding to the lens, the side surface of the spacer is inclined with respect to the bottom surface of the spacer and the distance between the optical member and the base plate is maintained at 10 mm or more.

Any reference in this specification to "one embodiment," "an embodiment," "example embodiment," etc., means that a particular feature, structure, or characteristic described in connection with the embodiment is included in at least one embodiment of the application. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lens, comprising:

a lens body;

a connection portion including a stopper that projects from an edge of a lower surface of the lens body; and a reinforcement portion that projects outwardly from a side surface of the lens body, wherein the stopper is configured to contact an upper surface of a base plate, and the connection portion is configured to the lens body to the base plate by passing through the base plate when the lens is coupled to the base plate, wherein a lower portion of the connection portion has a hook shape, wherein the hook shaped lower portion of the connection portion is configured to contact a lower surface of the base plate, wherein the connection portion is disposed in an x-axis direction, wherein the reinforcement portion is disposed in a y-axis direction vertical to the x-axis direction, wherein the x-axis direction and the y-axis direction pass through a center of the lens body, wherein the reinforcement portion has a lower surface that faces the base plate, wherein the lower surface of the reinforcement portion is flush with the lower surface the lens, and wherein the reinforcement portion is spaced from the base plate by a predetermined distance.

2. The lens according to claim 1, wherein the hook shaped lower portion of the connection portion is farther from an optical axis of the lens body than the stopper.

3. The lens according to claim 2, wherein the stopper is arranged between the hook shaped lower portion of the connection portion and the optical axis of the lens body.

4. The lens according to claim 1, wherein an upper surface of the lens body includes a groove, and the groove is in a central region of the upper surface of the lens body.

5. The lens according to claim 1, wherein the lens body has a maximum diameter at the lower surface, and the connecting portion extends in a region of the lower surface having the maximum diameter.

6. The lens according to claim 1, wherein the lower portion of the connection portion is configured to contact the lower surface of the base plate at a first region, the stopper is configured to contact the upper surface of the base plate at a second region, and the first region does not overlap with the second region in a direction parallel to the optical axis.

7. The lens according to claim 6, wherein the second region is closer to the center of the lens body than the first region.

8. The lens according to claim 1, wherein the stopper occupies an innermost area of the connection portion.

9. The lens according to claim 8, further including another connection portion, wherein the two connection portions are symmetrical to each other with respect to the x-axis direction.

10. The lens according to claim 9, wherein a distance between outermost portions of the lower portions of the connection portions is longer than a prescribed diameter of the lens body.

11. The lens according to claim 1, wherein a distance between the lower surface of the lens body and the upper surface of the base plate is constant.

12. A lamp unit, comprising:

a base plate having a plurality of holes;

a lens having a lens body, a connection portion including a stopper that projects from an edge of a lower surface of the lens body, and a reinforcement portion that projects outwardly from a side surface of the lens body, wherein the stopper is configured to contact an upper surface of the base plate, and the connection portion is configured to fix the lens body to the base plate by passing through the base plate when the lens is coupled to the base plate, wherein a lower portion of the connection portion has a hook shape, wherein the hook shaped lower portion of the connection portion is configured to contact a lower surface of the base plate, wherein the connection portion is disposed in an x-axis direction, wherein the reinforcement portion is disposed in a y-axis direction vertical to the x-axis direction, and wherein the x-axis direction and the y-axis direction pass through a center of the lens body;

a light source disposed on the base plate, wherein the lens is coupled to the base plate, and the lens covers the light source, wherein a distance between the lower surface of the lens body and the upper surface of the base plate is substantially constant, and wherein the lens body has a maximum diameter at the lower surface, and the connecting portion extends in a region of the lower surface having the maximum diameter;

an optical member that diffuses light emitted from the light source and having an irregular pattern on an upper surface thereof; and a spacer disposed between the base plate and the optical member, the spacer supporting an edge of the optical member and contacting the reinforcement portion.

13. The lamp unit according to claim 12, wherein the stopper separates the lower surface of the lens from the base plate and the light source by a predetermined distance so that the lower surface of the lens does not contact the base plate and the light source.

14. The lamp unit according to claim 12, wherein the base plate includes a curved surface having at least one curvature.

15. The lamp unit according to claim 12, wherein two stoppers are at edge regions of the lens, the light source is at a central region of the lens between the two stoppers, and the hook shaped lower portions of the two connection portions are arranged outside of the edge region of the lens, the stoppers contacting a surface of the base plate opposite with respect to a surface of the base plate contacted by said hook shaped lower portions.

16. A lens, comprising a lens body;

a connection portion including a stopper that projects from an edge of a lower surface of the lens body; and a reinforcement portion that projects outwardly from a side surface of the lens body, wherein the stopper is configured to contact an upper surface of a base plate, and the connection portion is configured to fix the lens body to the base plate by passing through the base plate when the lens is coupled to the base plate, wherein a lower portion of the connection portion has a hook shape, wherein the hook shaped lower portion of the connection portion is configured to contact a lower surface of the base plate, wherein the reinforcement portion has a lower surface facing the base plate, wherein the lower surface of the reinforcement portion is flush with the lower surface of the lens, and wherein the reinforcement portion is spaced from the base plate by a predetermined distance.

* * * * *